US006138572A

United States Patent [19]

Ruggles

[11] Patent Number: 6,138,572

[45] Date of Patent: Oct. 31, 2000

[54] THREE-BEAM PASSIVE INFRARED GUIDED MISSILE FUZE (U)

[75] Inventor: Richard L. Ruggles, Glendora, Calif.

[73] Assignee: The United States of America as represented by the Secretary of the Navy, Washington, D.C.

[21] Appl. No.: 05/120,681

[22] Filed: Mar. 3, 1971

[51] Int. Cl.[7] ..... F42B 13/02

[52] U.S. Cl. ..... 102/213; 244/3.16

[58] Field of Search ..... 102/70.2 P, 211–214; 244/3.16

[56] References Cited

U.S. PATENT DOCUMENTS

| | | | |
|---|---|---|---|
| 2,377,589 | 6/1945 | Sutcliffe | 244/3.16 |
| 2,415,348 | 2/1947 | Haigney | 244/3.16 |
| 2,424,193 | 7/1947 | Rost et al. | 244/3.16 |
| 2,520,433 | 8/1950 | Robinson | 244/3.16 |
| 2,997,595 | 8/1961 | Carey et al. | 244/3.16 |
| 3,129,424 | 4/1964 | Rabinow | 102/70.2 P |
| 3,130,308 | 4/1964 | Astheimer | 244/3.16 |

*Primary Examiner*—Harold J. Tudor
*Attorney, Agent, or Firm*—Harvey Fendelman; Michael A. Kagan; John Stan

[57] ABSTRACT

A passive, infrared, guided missile fuze, capable of detecting the presence of a target, having an axis which coincides substantially with the direction of forward motion of the missile, comprising three infrared detectors for detecting three separate beams of infrared electromagnetic radiation from the target, the beams forming angles with the axis. More specifically, the missile fuze detects the presence of a target when two of the infrared detectors simultaneously detect two beams of infrared radiation from the target. In a sophisticated embodiment, the fuze is able to determine in which quadrant of space the target is located.

9 Claims, 26 Drawing Sheets

TARGET SIZE = 9 FT.
RANGE = 9 FT.

CLOSING VELOCITY = 240 FT./SEC.
HORIZONTAL SCALE = 10 MSEC./CM.

TARGET SIZE = 9 FT.
RANGE = 9 FT.

CLOSING VELOCITY = 240 FT./SEC.
HORIZONTAL SCALE = 10 MSEC./CM.

CLOSING VELOCITY = 1200 FT./SEC.
HORIZONTAL SCALE = 2 MSEC./CM.

CLOSING VELOCITY = 1200 FT./SEC.
HORIZONTAL SCALE = 2 MSEC./CM.

CLOSING VELOCITY = 1000 FT./SEC.
HORIZONTAL SCALE = 1 MSEC./CM.

CLOSING VELOCITY = 1000 FT./SEC.
HORIZONTAL SCALE = 1 MSEC./CM.

DECOY SIZE = 1.7 FT.
RANGE = 15 FT.

CLOSING VELOCITY = 1880 FT./SEC.
HORIZONTAL SCALE = 1 MSEC./CM.

DECOY SIZE = 1.7 FT.
RANGE = 15 FT.

CLOSING VELOCITY = 1880 FT./SEC.
HORIZONTAL SCALE = 1 MSEC./CM.

BOXCAR 1 AND GATE FUNCTION GENERATOR.
206 & 208
+35V.
INPUT CHANNEL 1 SIGNAL FROM AMP. 146
GATE & BOXCAR 3
AT MULTIVIBRATOR
FROM AUXILIARY CHANNEL SQUARING CIRCUIT 168.
224
222

TARGET SIZE = 9 FT.
RANGE = 15 FT.
CLOSING VELOCITY = 280 FT/SEC.
HORIZONTAL SCALE = 10 MSEC./CM

INPUTS

OUTPUTS

TARGET SIZE = 9 FT.
RANGE = 15 FT.

CLOSING VELOCITY = 280 FT./SEC.
HORIZONTAL SCALE = 10 MSEC/CM.

DECOY SIZE = 4 FT.
RANGE = 18 FT.
CLOSING VELOCITY = 2000 FT./SEC.
HORIZONTAL SCALE = 2 MSEC./CM.

DECOY SIZE = 4 FT.
RANGE = 18 FT.

CLOSING VELOCITY = 2000 FT./SEC.
HORIZONTAL SCALE = 2 MSEC./CM.

DECOY SIZE = 6 FT.
RANGE = 18 FT
CLOSING VELOCITY = 1500 FT./SEC.
HORIZONTAL SCALE = 2 MSEC./CM.

DECOY SIZE = 6 FT.
RANGE = 18 FT.

CLOSING VELOCITY = 1500 FT./SEC.
HORIZONTAL SCALE = 2 MSEC./CM.

HORIZONTAL SCALE = 2 MSEC/MAJOR DIV.

HORIZONTAL SCALE: 2.5 MSEC./MAJOR DIV.

HORIZONTAL SCALE - 5 MSEC/MAJOR DIV.

FIG. 36.

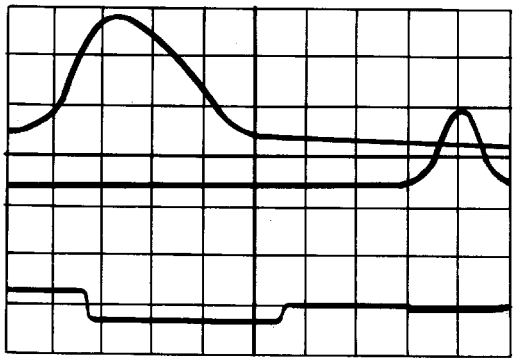

VERTICAL GAIN, TOP TRACE
1.0 V/CM

VERTICAL GAIN, CENTER TRACE
1.0 V/CM

VERTICAL GAIN, BOTTOM TRACE
1.0 V/CM

HORIZONTAL SWEEP
2 MSEC./CM.

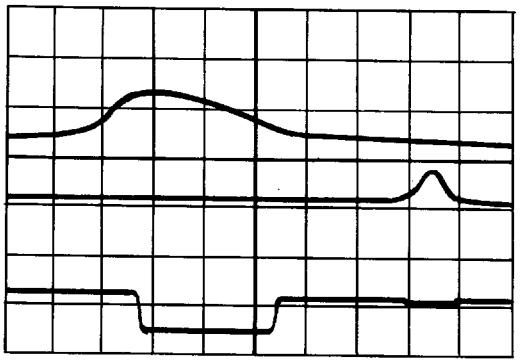

VERTICAL GAIN, TOP TRACE
1.0 V/CM

VERTICAL GAIN, CENTER TRACE
1.0 V/CM

VERTICAL GAIN, BOTTOM TRACE
1.0 V/CM

HORIZONTAL SWEEP
5 MSEC/CM

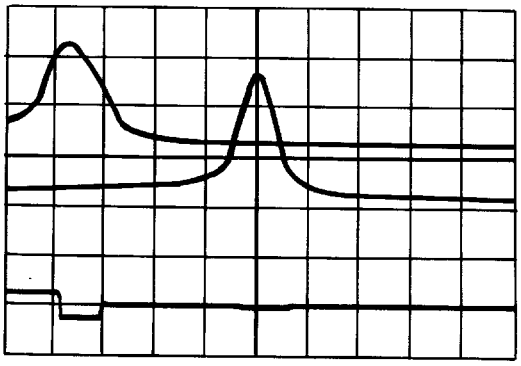

VERTICAL GAIN, TOP TRACE
0.5 V/CM

VERTICAL GAIN, CENTER TRACE
0.2 V/CM

VERTICAL GAIN, BOTTOM TRACE
1.0 V/CM

HORIZONTAL SWEEP
20 MSEC/CM.

TOP TRACES, DETECTOR SIGNAL, CHANNEL 1
CENTER TRACES, DETECTOR SIGNAL, AUXILIARY CHANNEL
BOTTOM TRACES, OUTPUT OF CIRCUIT (NO. 2)
(NO TARGET SIGNALS, EFFECTIVE DISCRIMINATOR)

THREE-BEAM PASSIVE INFRARED GUIDED MISSILE FUZE (U)

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

In the prior art, the typical passive infrared (IR) fuze design, for use on a guided missile against airborne targets, has two detection beams separated by some rather large angle, with one of these beams directed into the forward hemisphere ahead of the warhead expansion volume. The time relationships between signals in the two beams is processed to determine whether or not a detonation signal should be delivered to the warhead. This type of passive IR fuzing is susceptible to countermeasures in the form of "towed decoys" or properly deployed pyrotechnic flares.

SUMMARY OF THE INVENTION

The invention relates to a passive infrared (I) guided missile fuze, having three detectors for detecting three IR beams, whose outputs feed into three channels, a first, an auxiliary and a second channel, the order of the channels corresponding to the order in which an IR signal beam from the target is received. The first and auxiliary channel detectors are so positioned that the first two IR beams received from the target have a sufficiently large angular deviation between them to permit discriminating between a comparatively large real target and a smaller decoy target. A real target would be coincidentally received by these two detectors, while a decoy target would be intercepted by the two detectors one at a time. Circuitry connected to the output of the third detector, termed second channel circuitry, activates a fuze after the two frontal detectors have detected a real target.

The addition of a third detection beam to a passive IR fuze was first conceived to provide the fuze with a means for discriminating against countermeasures using decoys. However, the three beam concept has the potential for improving fuze performance in other areas such as burst point timing and $P_K$. The third detection beam, hereafter referred to as the auxiliary beam, is used in conjunction with the most forward of the standard detection beams of the prior art to make a "size" measurement of radiating sources passing through their field of view. Aircraft plumes are characterized as being large sources relative to the plume sizes expected for decoys. This statement may not be rigorously true in all cases, but, after some consideration, it has been shown to be general enough for the basis of a useful counter-countermeasure (CCM).

The size measurement is achieved by making the angular separation between the auxiliary beam and the forward beam small enough so that the smallest expected targets, that is to say, the minimum target size at the maximum kill range, bridge the separation or dead zone between the two beams and "overlap". Smaller sources (the majority of decoys) do not "overlap" and may be discriminated against. This concept has been named the "Overlapping Signal Counter Countermeasure" (OSCCM). The size referred to above is an angular subtend at the windows of the fuze which is range (miss distance) dependent; therefore, the decoy discrimination characteristics are a function of range as well as physical decoy size.

A variation or extension of the basic OSCCM has been developed based upon the premise that the location of the peak or irradiance for a particular source relative to its overall irradiance signature (relative symmetry) is information useful in making a target-decoy decision. This variation is called the Time to Peak Modified Overlapping Signal Counter Countermeasure (TTPOSCCM).

In this more sophisticated embodiment, the IR detector which first detects the presence of the target, the first channel detector, monitors the IR radiation and records the instant of time at which a maximum amount of infrared radiation is detected. The presence of a target is determined when this maximum amount of radiation is detected by the first channel detector simultaneously with the detection by the auxiliary channel detector of IR radiation from the target having a magnitude greater than a predetermined threshold level.

A yet more refined passive, infrared, guided, missile fuze has four quadrant IR detectors, instead of one, associated with the auxiliary channel, which permit determination of the particular quadrant in space in which the real target is present. Aiming means within the fuze are able to cause it to be propelled into the particular quadrant where it had been determined that the target was located, resulting in a more nearly dead hit.

In the earlier described embodiments, not having the feature of quadrant detection, the guided missile fuze behaved as a proximity fuze.

STATEMENT OF THE OBJECTS OF THE INVENTION

It is an object of the invention to provide a three-beam IR missile fuze which is able to discriminate between a relatively large real target and a smaller decoy target.

Another object is to provide an IR missile fuze which is able to correlate the detection of a maximum IR input signal in one channel to the detection of IR radiation in another, auxiliary, channel to make more certain the probability of detecting a real rather than decoy target.

A further object of the invention is the provision of an IR guided missile fuze which is able to determine the quadrant of space in which a target is located.

Still another object is to provide an IR missile fuze which, having determined in which quadrant of space a real target is located, is able to cause the missile to be directed toward the target.

Other objects, advantages and novel features of the invention will become apparent from the following detailed description of the invention when considered in conjunction with the accompanying drawings wherein:

BRIEF DESCRIPTION OF THE DRAWINGS

FIGS. 32A–34D are a circuit diagram for the TTPOSCCM Ckt. No. 2 with quadrant detection.

FIG. 33 is a set of signal waveforms developed in TTPOSCCM circuit No. 2 with quadrant detection at high velocity intercept.

FIG. 34 is a set of signal waveforms developed in TTPOSCCM Ckt. No. 2 with quadrant detection at medium velocity intercept.

FIG. 36 is a set of graphs showing the sun signal rejection characteristics for the TTPOSCCM Ckt. No. 2 with 8 degrees of separation between channels.

DESCRIPTION OF THE PREFERRED EMBODIMENTS

Figure 1:
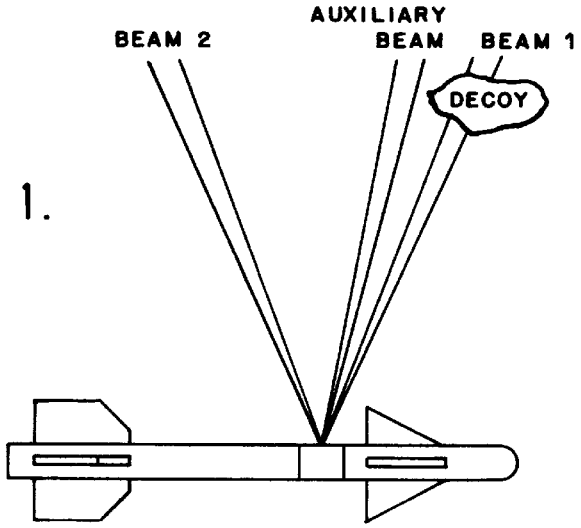
FIG. 1 is a diagrammatic view of the three-beam fuze IR source intercept geometry.

FIG. 1 illustrates the three-beam fuze 100 in an intercept with a flare decoy 102. This drawing illustrates the basic principles of the overlapping signal CCM, OSCCM, and how the time-to-peak measurement aids in decoy discrimination. The decoy 102 is shown in beam 1 about to enter the auxiliary beam. This particular decoy 102 at this range would be identified as a target by the OSCCM. The TTPOSCCM will however determine that the peak of the decoy signal in beam 1 had passed before the decoy 102 entered the auxiliary beam and thereby properly identify the source as a decoy target. Real targets are identified by their longer overall length and their unsymmetrical shape which places the peak signal near the tailpipe.

Flare decoy irradiance signature data has been taken under simulated altitude and wind velocity conditions to determine the validity of the assumptions above and to quantitatively evaluate the decoy discrimination capability of the three-beam concepts.

The function of beam 2 in both the OSCCM and the TTPOSCCCM is primarily for establishing the detonation time. The decision as to the type of an object scanned, decoy target 102 or real target 100, is performed by the combination of beam 1 and the auxiliary beam. The memory time feature used in conventional prior art IR fuzes is still applied. However, the effectiveness of this memory feature for decoy discrimination and sun signal rejection is, in most instances, a duplication of the discrimination inherent in the OSCCM circuit.

The angular separation between channel 1 and the auxiliary channel is an important parameter of the OSCCM scheme. It can be seen from FIG. 2 that if the IR source 110 is larger than the separation $n_a$R, a signal appears in the auxiliary channel before the signal ends in channel 1. The two signals thus overlap in time. There is no coincidence of signals if the source 110 is smaller than the separation.

Figure 3A:
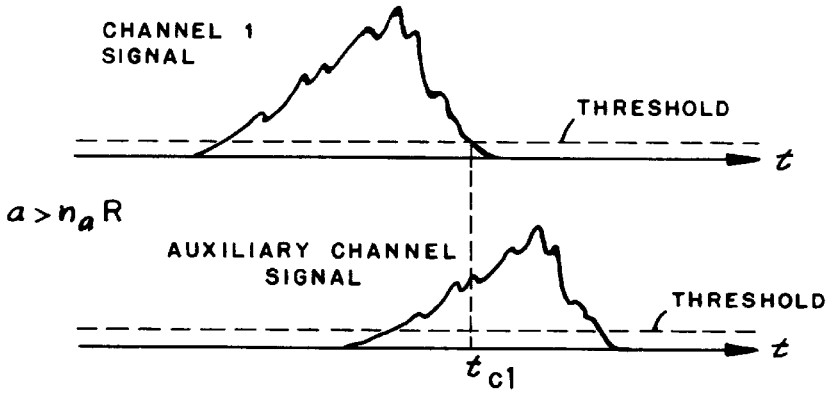
FIGS. 3A and 3B are a pair of graphs showing the signal coincidence relationships in the first channel and the auxiliary channel for the OSCCM.
Figure 3B:
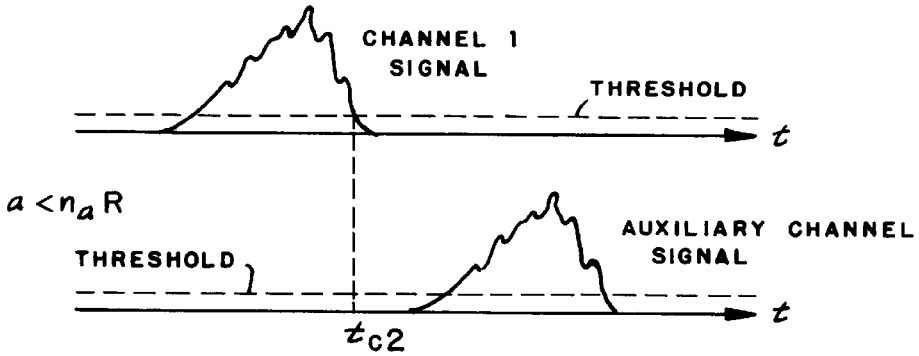

An illustration of the two cases is shown in FIG. 3. It is seen that, by using a rather crude approximation, the condition for decoy 102 discrimination is $$a_D < n_a R, \tag{1}$$

where $a_D$ is decoy size (more accurately, projection of decoy size in the direction of the closing velocity vector), R is the minimum range (miss distance), and $n_a$ is the geometry factor defining the separation between channel 1 and the auxiliary channel.

Figure 4:
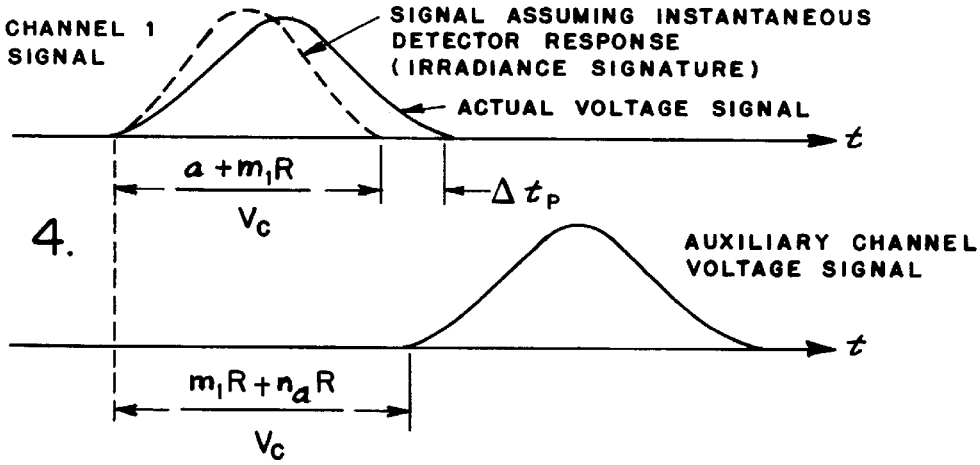
FIG. 4 is a graph showing the relative parameters defining time between the first and auxiliary channels and the first channel signal duration.

A more realistic condition for decoy discrimination can be determined with the help of FIG. 4. Neglecting threshold effects, the signal duration in channel 1 is given by $$t_p = \frac{a + m_1 R}{V_c} + \Delta t_p, \tag{2}$$

where $t_p$=signal duration in channel 1, a=source size, $m_1$=geometry factor determining the width of channel 1, $V_c$=relative closing velocity between the fuze and the object, and $\Delta t_p$=additional signal duration due to detector decay time-constant.

Another time of interest is given by $$t_1 = \frac{m_1 R + n_a R}{V_c}, \tag{3}$$

where $t_1$ is the time interval between the beginning of the signal in channel 1 and the beginning of the signal in the auxiliary channel.

The object is considered to be a decoy if $$t_p - t_1 < 0 \tag{4}$$

or $$\frac{a + m_1 R}{V_c} + \Delta t_p - \frac{m_1 R + n_a R}{V_c} < 0 \tag{5}$$

Equation (5) simplifies to $$a + V_c \Delta t_p < n_a R \tag{6}$$

or $$a_{eff} < n_a R, \tag{7}$$

where $$a_{eff} = a + V_c \Delta t_p \tag{8}$$

The effects of closing velocities on the discrimination characteristics are most apparent in Equation 6. In this equation, the sum of the physical decoy signature length and an apparent length (velocity×time), is compared to the separation between channels which is a physical length for a particular path through the beams.

The additional signal duration ($\Delta t_p$) is in reality a function of closing velocity and the amplitude and shape of the irradiance signal. The apparent length ($V_c \Delta t_p$) is a major contributor to the effective decoy size ($a_{eff}$) for small decoys. This is particularly true when the decoy irradiance signature is of high amplitude, with the irradiance peak near the end of the signature. Consider, for example, a=0.5 ft. and $\Delta t_p$=1 msec (which is equivalent to two or three times the typical lead sulfide (PbS) detector time constant). If $V_c$ ranges from 1000 to 3000 ft/sec, the effective decoy length varies from 1.5 to 3.5 ft.

Although the OSCCM scheme checks for time-overlapping (or coincidence) of signals in channel 1 and the auxiliary channel, in essence, the time overlapping is the manifestation of a spatial overlapping of a source between beams as modified by the detection bandwidth limitations discussed above. For reasons which will be explained in connection with the multiple-source problem, the overlapping of signals is checked at the end of each channel 1 signal. The spatial overlapping aspect makes the OSCCM system uniquely different from the typical 2 channel fuze system of the prior art which checks for coincidence of signals within a preset memory time. The major difference between the two systems is the ability of the OSCCM to utilize the geometric properties of the optical channels for approximate size discrimination.

The previous analysis was based on a single isolated source passing through the fuze field of view (FOV). In some situations a number of IR sources could be passing the fuze in succession. A single pyrotechnic flare decoy may be sparking or breaking up as it passes through the fuze detection beams, a salvo deployment of small flares might be encountered, or a target may pass through the field of view immediately after a decoy.

Figure 5:
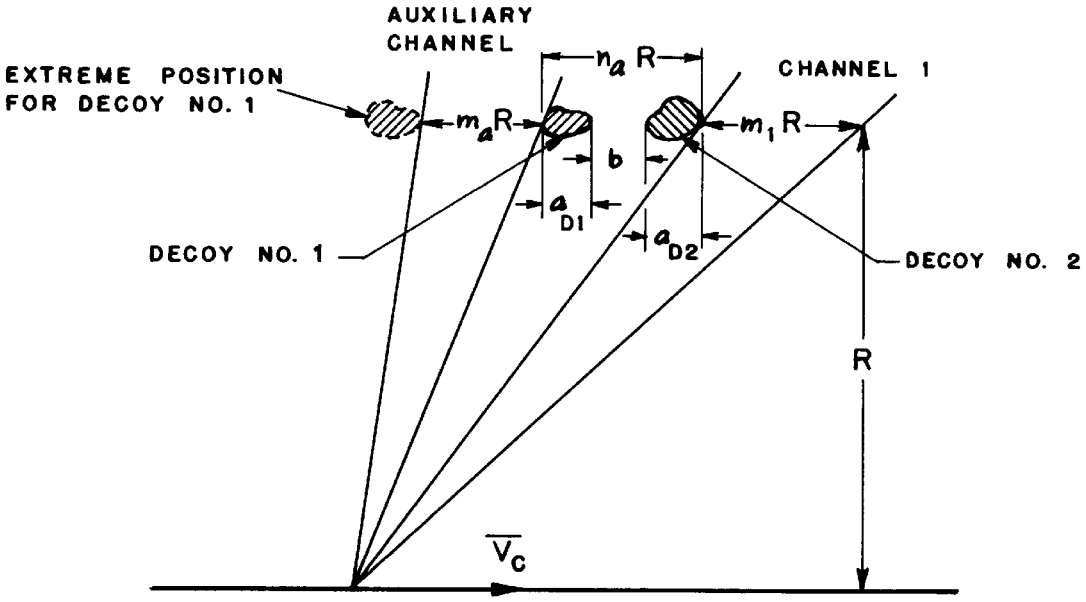
FIG. 5 is a diagram showing two-decoy intercept geometry, with the decoys displaced horizontally.

Referring now to FIG. 5, if a combination of two decoys is to be interpreted by the OSCCM as a target, then at the time that one of the decoys 122 is leaving the FOV of channel 1, shown as decoy No. 2, the other decoy 124, shown as decoy No. 1, must be crossing the FOV of the auxiliary channel. FIG. 5 illustrates the case where the decoys 122 and 124 are crossing channel 1 and the auxiliary channel on a line parallel to the fuze axis 26. If this combination of decoys 122 and 124 is to be identified properly, either of the following two conditions must be met:

$$a_{D1} + b + a_{D2} > n_a R \tag{9}$$

or $$b + a_{D2} > m_a R + n_a R \tag{10}$$

If $a_{D1}$ is added to both sides of the inequality (10) and if $a_{D1}+b+a_{D2}$ is defined as $$a_{D1} + b + a_{D2} \equiv a_{Deff} \tag{11}$$

then the combination of the two decoys 122 and 124 having an effective width of $a_{Deff}$ will be mistaken as a target when the following is true:

$$n_a R < a_{Deff} < a_{D1} + (m_a + n_a) R \tag{12}$$

As shown in FIG. 5, the tolerance for $a_{Deff}$ is $a_{D1}+m_a R$. In order to reduce this tolerance, it would be desirable to make $m_a$ as small as possible. It should be remembered, however, that the auxiliary channel has to provide a signal of sufficient amplitude for coincidence checks on target plumes. It should be noted also that since the coincidence may occur during any part of the auxiliary channel signal (e.g. low amplitude portion of the leading edge), the amplitude requirement has to be satisfied for large portions of the target signal, not only at its peak value.

Figure 6:
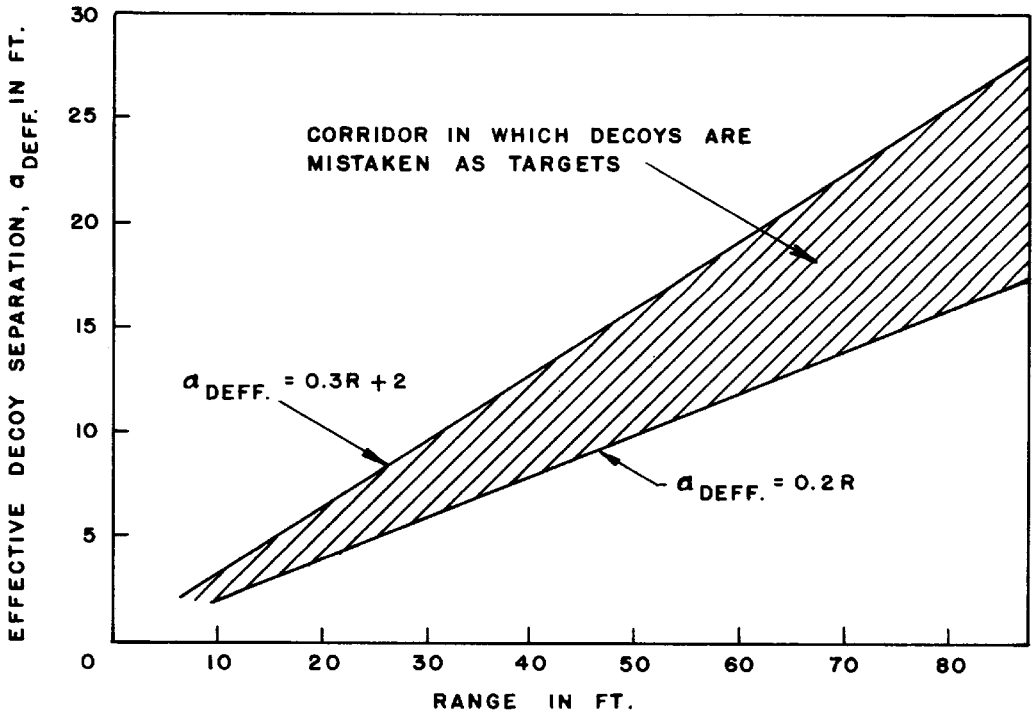
FIG. 6 is a graph showing the confusion corridor for effective two-decoy separation.

As an example, let $n_a$=0.2, $m_a$=0.1 and $a_{D1}$=2 ft. The corridor for the decoy combinations which will make them appear as a target is then shown in FIG. 6. It should be noted that the size of the corridor which results in decoy confusion increases with increasing range. Thus, for example, at R=25 ft the minimum effective decoy separation must be 5 ft, and the maximum separation cannot exceed 8 ft. The corridor at R=25 ft is thus 3 ft wide. At R=75 ft, the minimum effective decoy separation must be 15 ft, and the maximum separation cannot exceed 24 ft. The width of the corridor at R=75 ft is 9 ft wide.

Figure 7:
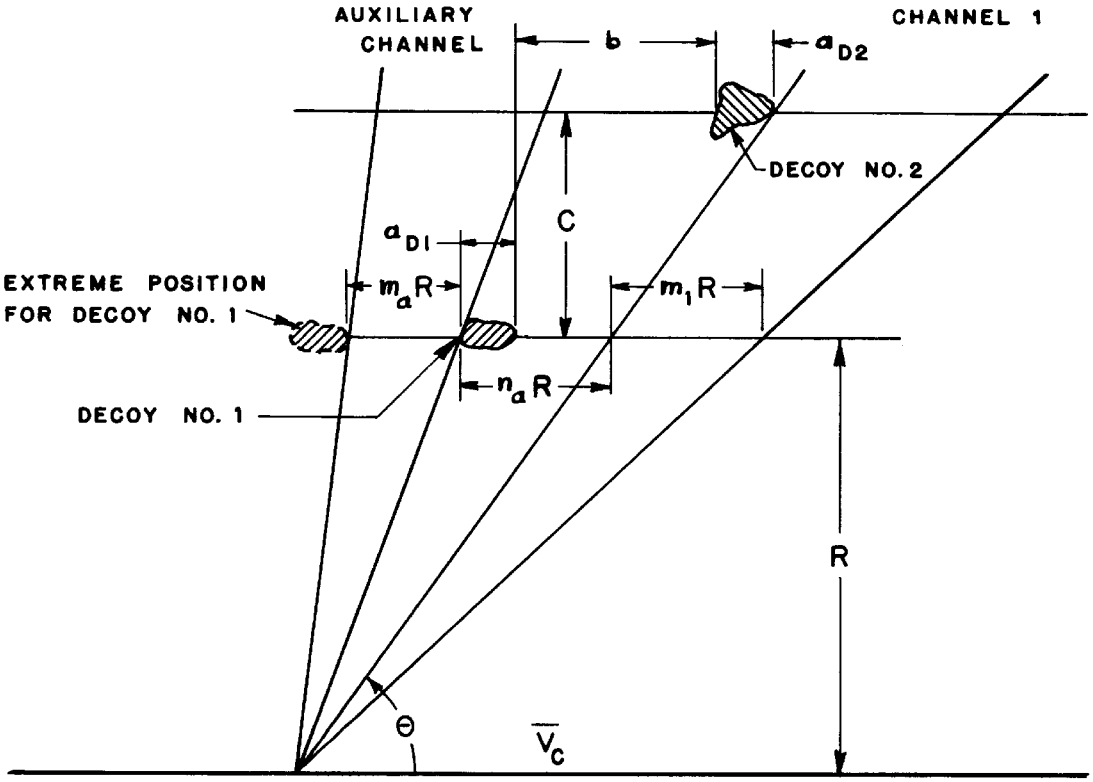
FIG. 7 is a diagram showing two-decoy intercept geometry with the decoys displaced horizontally and vertically.

Referring now to FIG. 7, conditions for two decoys 122 and 124 that are separated both horizontally and vertically will be obtained. There are two cases:

(a) decoy No. 1 closer to the fuze than decoy No. 2; and (b) decoy No. 2 closer to the fuze than decoy No. 1.

If the vertical and horizontal spacings (vertical defined here in the sense along R and horizontal defined as perpendicular to R) between the two decoys 122 and 124 are assigned proper polarities, the two cases can be combined into one. Thus in FIG. 7, b is the distance measured from the trailing edge of decoy No. 1, 124, to the leading edge of decoy No. 2, 122, and is positive in the direction of $\overline{V}_c$. Also, c is the vertical displacement measured from decoy No. 1, 124, to decoy No. 2, 122, and is positive in the direction away from the fuze.

From FIG. 7 the following conditions are seen to be necessary if the two decoys 124 and 122 are to be mistaken for a target:

$$a_{D1}+b+a_{D2}>n_a\mathrm{R}+c\cot\theta \tag{13}$$

or $$b+a_{D2}<m_a\mathrm{R}+n_a\mathrm{R}+c\cot\theta \tag{14}$$

Defining $$a_{D1}+b+a_{D2}-c\cot\theta\equiv a_{Deff} \tag{15}$$

the two inequalities (13) and (14) can be combined into the following:

$$n_a\mathrm{R}<a_{Deff}<a_{D1}+(m_a+n_a)\mathrm{R}, \tag{16}$$

which is identical to inequality (12). In fact, Eq. (11) is a special case of Eq. 15 (c=0). The confusion corridor wherein decoys 122 and 124 may be confused as targets again has a range equal to $a_{D1}+m_a\mathrm{R}$. The effective decoy separation, however, has been reduced by c cot θ. It is to be noted that if decoy No. 1, 124, is further away from the fuze than decoy No. 2, 122, c is negative and thus the effective decoy separation would be increased by |c cot θ|. The same illustration as used for the case of the two decoys 122 and 124 spaced horizontally also applies here (see FIG. 6).

The above analysis can be extended to more than two sources and expressed simply in the following qualitative statement: The probability that the OSCCM will produce a target indication in a multiple-decoy situation is the same as the probability that at least one of the decoys 124 will be in the process of crossing the auxiliary channel at the instant another decoy 122 is emerging from channel 1. The corridor of confusion (see FIG. 6) in terms of time is only a few milliseconds wide. It is thus considered that given separate decoys, the probability of their combination being mistaken by the OSCCM as a target is low. With the appearance of sparking decoys this probability would, of course, increase.

There is a remote possibility that the OSCCM system could be triggered prematurely by a decoy arriving in channel 2 after a target has been received in channel 1 and the auxiliary channel. After a target has crossed channel 1, a signal indicating coincidence will be generated and held by a memory circuit for a preset duration of time. If, during this memory time, a decoy crosses channel 2 before the target, an early triggering of the fuze would result. The same problem exists, of course, in a conventional two beam fuze of the prior art. The main problem in a conventional fuze, however, is the single decoy actuating both channels within the preset memory time and triggering the fuze. The probability of this is greatly diminished by the OSCCM scheme.

Improvement in the discrimination effectiveness of the OSCCM system is possible if coincidence of signals in channel 1 and the auxiliary channel is based on a particular portion of the signal in channel 1 rather than on the entire signal. The particular part of the signal referred to above extends from the start of the signal to its absolute peak. One reason for using this portion of the signal is to overcome the detrimental effects of signal decay time caused by the @ detector time constant. Another reason is to gain decoy discrimination effectiveness by capitalizing on the differences in symmetry between decoy and target signatures.

Figure 8:
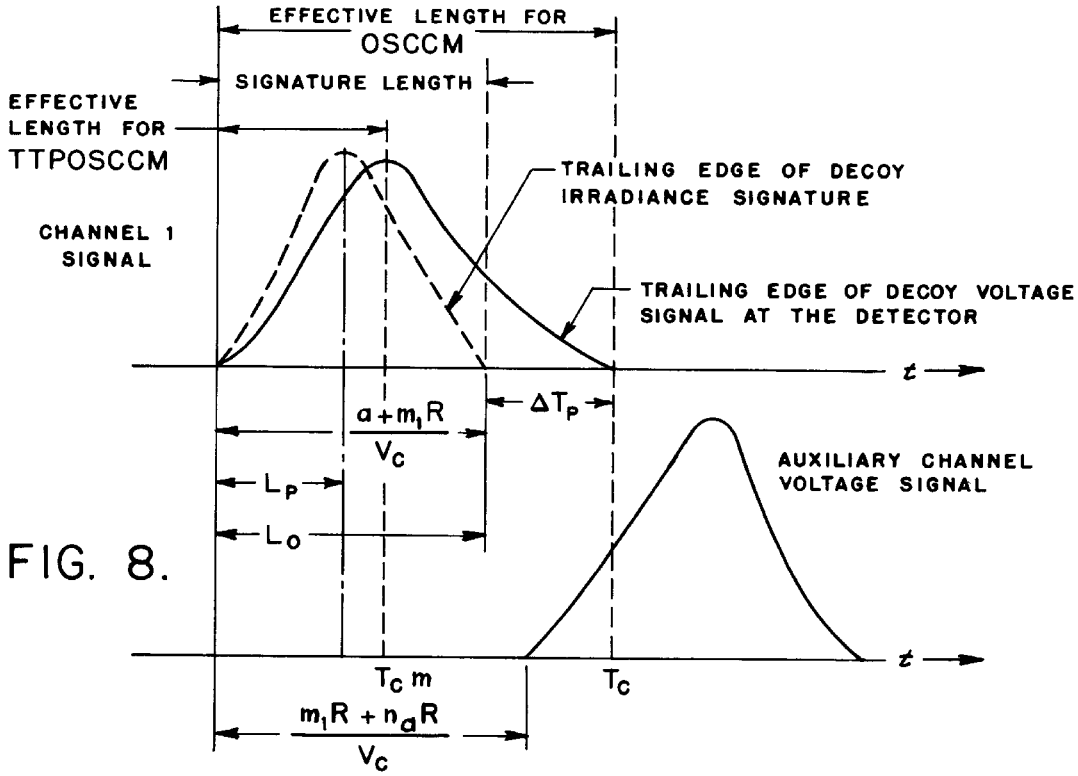
FIG. 8 is a diagram showing signal coincidence time relationships for a decoy type signature.

The modified coincidence check is illustrated in FIG. 8. The coincidence of signals in the OSCCM system is checked at $t=t_c$, designated by reference numeral 132, which indicates the end of channel 1 signal. In the TTPOSCCM the signal coincidence check would be performed at $t=t_{cm}$, designated by reference numeral 134, which is the time of the absolute peak of channel 1 signal. The illustration shows that in the OSCCM system the decoy would have been mistaken for a target, while in the TTPOSCCM version it is correctly recognized as a decoy, since there is no coincidence of signals. It is apparent from FIG. 8 that the "effective" length of the decoy signature has been reduced considerably. Effective length for the TTPOSCCM is defined as the portion of the decoy signature from its leading edge, the edge seen first by the fuze, to a point resulting in maximum voltage signal. Note that the effective length of a signal for the TTPOSCCM could vary from a fraction to its full signature length depending upon the distribution of its radiance. The ratio of the distance to the signature peak $L_p$ divided by the overall signature length $L_o$ is called the "shape factor". This parameter is used as a convenience in describing the important feature of a signature (relative symmetry) as it pertains to the TTPOSCCM. In the case of targets, the assumption is that the maximum radiance occurs at or in the vicinity of the tailpipe, indicating that the effective length of a target signature for the TTPOSCCM is its full length, or very nearly so. Therefore targets are characterized by a shape factor slightly less than unity.

Figure 9:
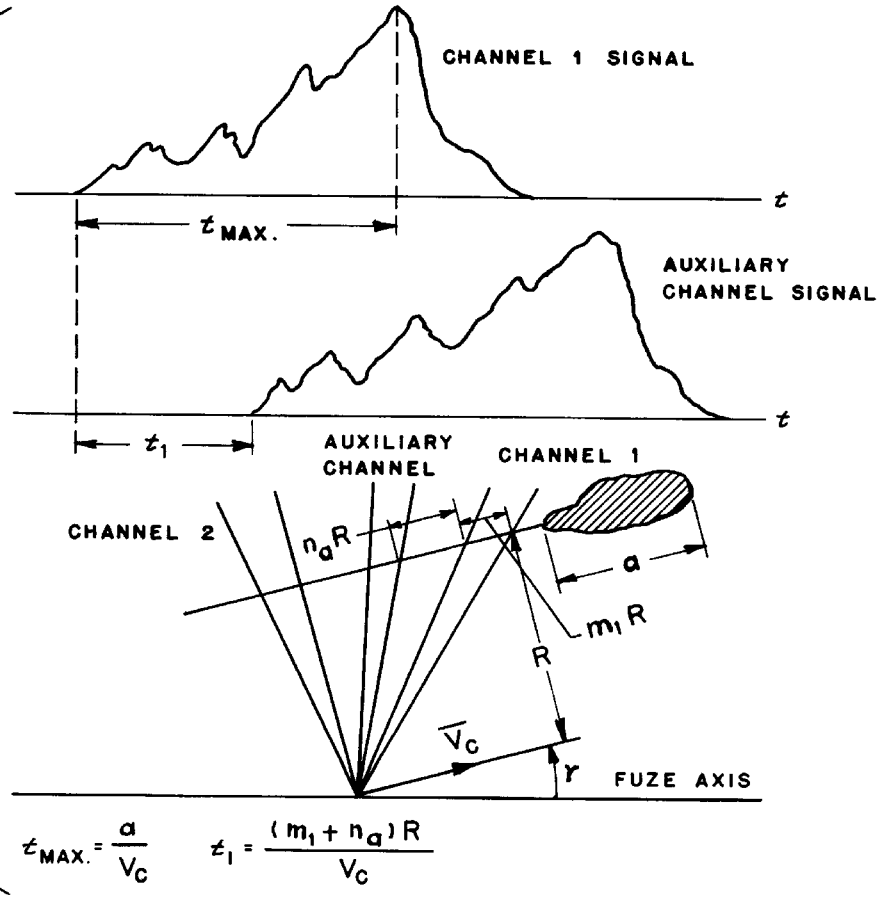
FIG. 9 is a diagram and a graph showing the geometry for coincidence of target signals.

The geometry for coincidence of target signals is seen in FIG. 9. The condition for targets is as follows:

$$t_{max}-t_1\geqq 0 \tag{17}$$

or $$\frac{a_T}{V_c}-\frac{(m_1+n_a)R}{V_c}>0 \tag{18}$$

or $$a_T>(m_1+n_a)\mathrm{R} \tag{19}$$

The separation between channels must, therefore, be adjusted such that $$n_a\leqq a_{Tmin}/\mathrm{R}_{Tmax}-m_1, \tag{20}$$

where $a_{Tmin}$ is the minimum target size and $R_{Tmax}$ is the maximum target miss distance. Note that in the OSCCM system, the separation had to be adjusted such that $n_a\leqq a_{Tmin}/R_{Tmax}$. With the same $a_{Tmin}$ and $R_{Tmax}$, the separation between channels is smaller in the TTPOSCCM than in the OSCCM. For example, if $a_{Tmin}$=6 ft., $R_{Tmax}$=25 ft., and $m_1$=0.1, then $$n_a|_{OSCCM} = 0.24$$

and $$n_a|_{TTPOSCCM} = 0.14$$

The condition for decoy discrimination is $$\frac{ka_D}{V_c} - \frac{(m_1 + n_a)R}{V_c} < 0 \quad (21)$$

or $$ka_D < (m_1 + n_a)R, \quad (22)$$

where k is the shape factor, which ranges from zero to one ($ka_D$ is approximately the effective decoy signature length).

From Eq. (6) the condition for decoy discrimination for the OSCCM system is $$\frac{a_D - n_{au}R}{V_c} + \Delta t_p < 0 \quad (23)$$

or $$a_D > n_{au}R - \Delta t_p V_c \quad (24)$$

or $$a_D > (n_a + m_1)R - \Delta t_p V_c, \quad (25)$$

where $n_{au}$ is the separation factor for the OSCCM system.

Comparing Eqs. (22) and (25), one notes that in the TTPOSCCM it is the effective signature length that is compared with the right-hand side of Eq. (22), while the actual decoy signature length is used in Eq. (25) for the OSCCM. For a symmetrical signature (k=0.5), symmetry alone would indicate a gain of a factor of two in the discrimination capability of the TTPOSCCM. Note also that even if k=1, the right-hand side of Eq. (22) is larger than that of Eq. (25) by a quantity $\Delta t_p V_c$. This quantity corresponds to the additional gain in discrimination capability obtained by using the TTPOSCCM system. As an example, let k=0.5, $n_a$=0.14, m=0.1, R=20 ft., $\Delta t_p$=1 msec, and $V_c$=2000 ft/sec. The gain in length discrimination is $$\left(\frac{m_l + n_a}{k} - n_a - m_l\right)R + \Delta t_p V_c = 4.8\,\text{ft.} + a\,\text{ft.} = 6.8\,\text{ft.}$$

a ft.=6.8 ft.

Note that this gain is due to the reduced effective decoy signature size.

The following sections discuss in some detail the circuit developed for the OSCCM and two TTPOSCCM circuits. The circuit shown for the OSCCM and the first of the two circuits shown for the TTPOSCCM are "laboratory only" models suitable for laboratory evaluation of the OSCCM and TTPOSCCM concepts. Although two are laboratory models, fundamentally, they are very similar in structure to operational models of the same sort. The second TTPOSCCM circuit is functionally much the same as the first but with improvements to make it better suited for a realistic missile application.

The bulk of the data taken during the intercept simulations to evaluate the target identification—decoy rejection characteristics of the TTPOSCCM concept was taken with the first circuit. The second circuit was evaluated to a lesser extent in the above area but with more attention directed towards determining the sun background rejection capability of the circuit. In each case, the simulation data for a particular circuit follows immediately after the description of that circuit to minimize possible confusion.

The electronic system for the OSCCM technique performs two functions:

(1) It determines whether or not an object passing through the fuze FOV "overlaps" beam 1 and the auxiliary beam (target or decoy decision information).

(2) It generates a triggering signal on the basis of information from beam 2.

Figure 10:
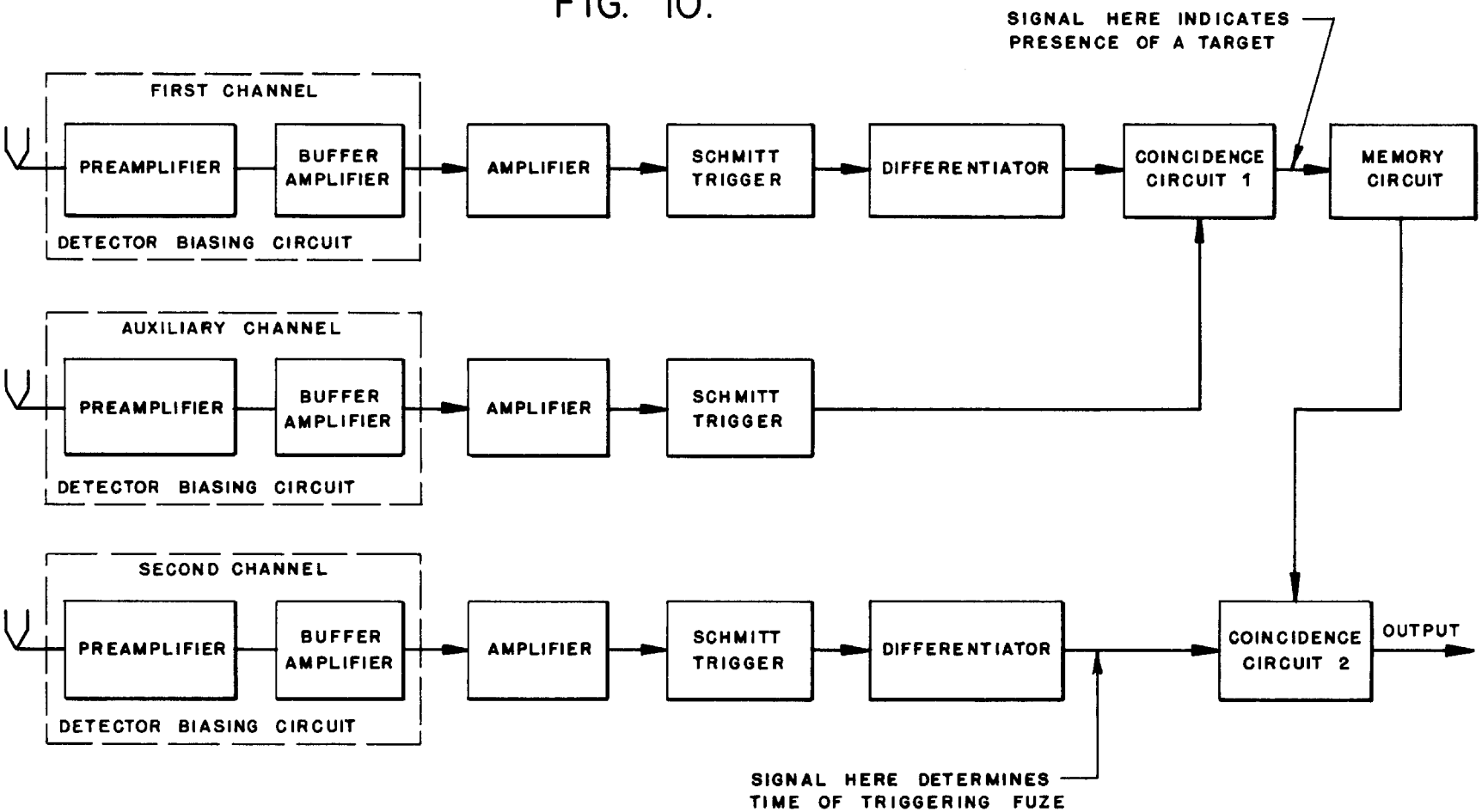
FIG. 10 is a block diagram of the OSCCM circuits.

The circuitry for achieving the just-recited functions is shown in block diagram form in the embodiment 140 shown in FIG. 10. The combination of first channel circuits, designated by reference numerals 143, 146, 148, 152 and 154, and of the auxiliary channel circuits 163, 166 and 168 check for time coincidence of input signals 141 and 161. If there is a time coincidence, a pulse is generated at lead 155, indicating the presence of a target and is fed into the memory circuit 156.

As shown in FIG. 10, the circuits 183, 186, 188, 192 and 194, of channel 2 simply provide information on when to trigger the fuze. The output of the Schmitt trigger 2, 188, in channel 2 is differentiated in channel 2 differentiator 192 to determine the end of the signal. Coincidence circuit 2, 194, an AND gate, will generate a triggering pulse at output 196 if a signal 157 from the memory circuit 156 and a signal 193 from the output of the channel 2 differentiator 192 are present simultaneously. For laboratory evaluation purposes, only the part of the circuitry involving channel 1 and the auxiliary channel, up to the output of coincidence circuit 1, 154, was used. The circuitry in channel 2 is not necessary for making a target-decoy decision.

Figure 11:
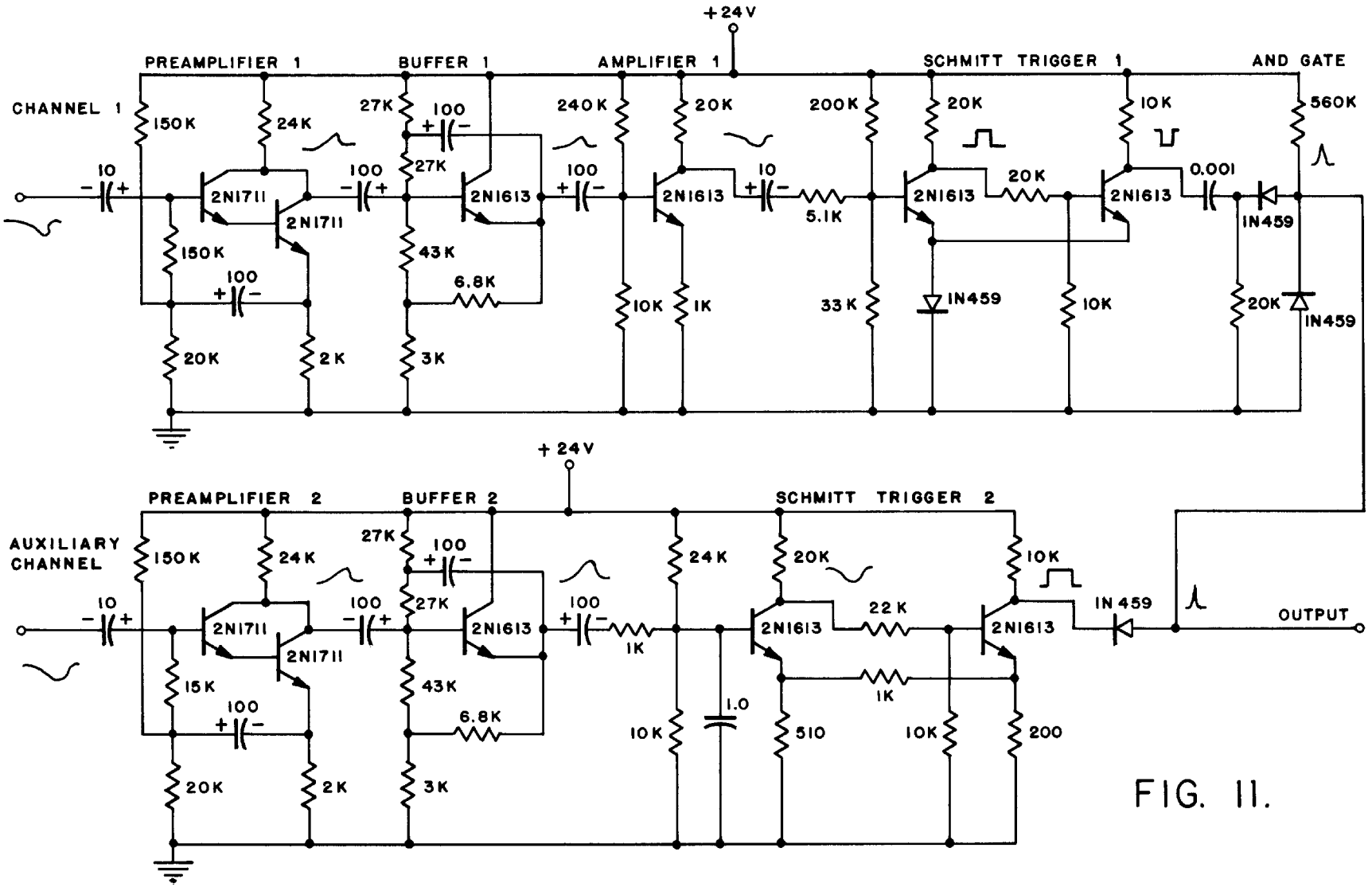
FIG. 11 is an OSCCM schematic diagram.

A schematic of the OSCCM "decision" circuitry is shown in FIG. 11. The circuit consists basically of two branches: circuits in the channel 1 branch and circuits in the auxiliary channel branch. The outputs of the two branches merge in an AND gate 154. Summarizing the operation of the circuitry shown in FIG. 11, the OSCCM circuitry takes the output signals from the detectors 143 and 163 of channel 1 and the auxiliary channel, each consisting of a preamplifier 142 and 162, and a buffer amplifier, 144 and 164, amplifies and shapes these signals into square pulses, and then checks for coincidence of these signals.

Both input signals 141S and 161S are fed into high input impedance preamplifiers 142 and 162. The preamplifiers use two-transistor Darlington configurations with base-bias circuit bootstrapping to increase their input impedance. The preamplifiers 142 and 162 have a voltage gain of approximately 12 and operate properly over the selected input voltage range of 0.1 v to 2 volts.

The outputs of the preamplifiers 142 and 162, both in channel 1 and the auxiliary channel, are capacitively coupled to a buffer or emitter follower circuit, 144 and 164, respectively. The buffer also uses base-bias bootstrapping to increase the input impedance. The buffers 144 and 164 are used to prevent excessive loading of the pre-amplifier stages 142 and 162. Each buffer 144 and 164 has a voltage gain of approximately one, an input impedance of approximately 200K ohms, and retains the polarity of its input signal.

The output signal of the buffer stage 144 in channel 1 is amplified by amplifier 146 and used to trigger a Schmitt trigger circuit 148 which squares the signal at a level approximately equal to an input of 20–30 mv at preamplifier 1, 142. The output of Schmitt trigger 1, 148, is differentiated and applied to an AND gate 154.

Similarly, the signal in the auxiliary channel from buffer 2, 164, is operated on by Schmitt trigger 2, 168, and applied directly to the AND gate 154. If coincidence of the output signal from Schmitt trigger 2, 168, and the positive differentiated pulse from Schmitt trigger 1, 148, occurs, a positive signal of about 10 volts is obtained at the output of the AND gate 154. If coincidence is marginal, the output of the gate 154 may vary anywhere from zero to 10 volts.

To avoid the difficulty of interpreting the results in marginal cases, another Schmitt trigger circuit was used which yielded a square pulse if the gate signal was equal to 3 volts or more and no signal if the date output was less than 3 volts. This Schmitt trigger circuit is not shown in the basic schematic of FIG. 11, since its main purpose was to aid the operator in interpretation of the results.

It should be noted that all values of capacitors shown in FIG. 11 are in microfarads.

Pictures showing the signal waveforms generated during laboratory simulation are presented in FIGS. 12 through 15. To best illustrate the operation of the OSCCM system, the waveforms were selected at two points in the circuitry, i.e. at the input 141 and 161 to the preamplifiers 142 and 162 and at the output of the two Schmitt trigger circuits 148 and 168. All waveforms were obtained for an angular spacing between channel 1 and the auxiliary channel of five-and-one-half degrees (Refer back to FIG. 1).

Figure 12A:
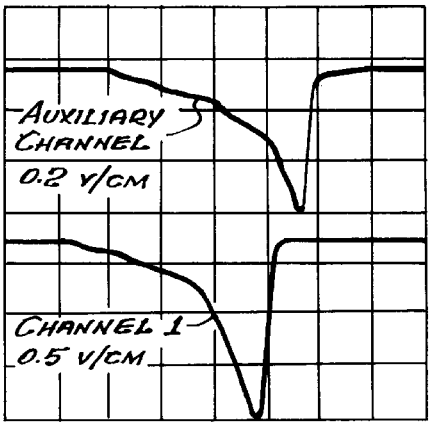
FIGS. 12A and 12B are a pair of graphs showing the target input signal waveforms for first and auxiliary channel spacing of five-and-one-half degrees.
Figure 12B:
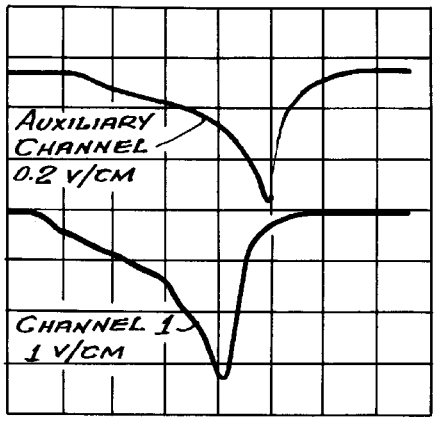

FIG. 12 displays the target input signal waveforms, 141S and 161S in FIG. 10, for channel 1 and the auxiliary channel at two closing velocities. The target size is 9 ft. and the range, or miss distance, is also 9 ft. FIG. 12*a* shows the case for a low closing velocity, about 240 ft/sec. Note the wide overlapping of the two signals in time, about 30 msec. The two signals differ in amplitude because of different detector sensitivities and different optical gains. The speed of the chopping disk used for the simulation was increased for the waveforms in FIG. 12*b* and the overlapping between signals diminished to about 7 milliseconds.

Figure 13A:
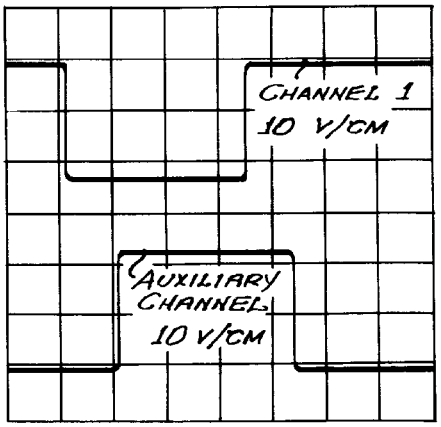
FIGS. 13A and 13B are a pair of graphs showing Schmitt trigger output signal waveforms for first and auxiliary channel spacing of five-and-one-half degrees.
Figure 13B:
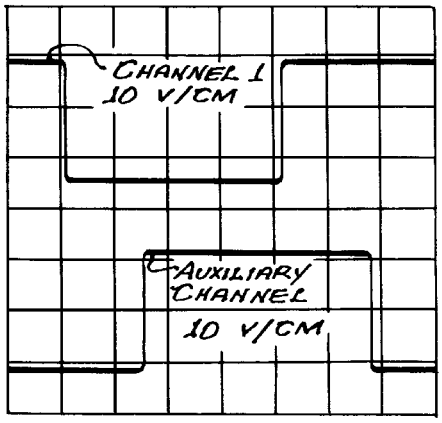

FIG. 13 displays target signal waveforms at the outputs of the Schmitt trigger circuits, 148 and 168 in FIGS. 10 and 11, in channel 1 and the auxiliary channel, respectively, for approximately the same conditions as in FIG. 12. As seen in FIG. 13, the over-lapping is about 25 msec for the low velocity case and about 6 msec for the medium velocity case. The separation of five-and-one-half degrees between channels leaves a wide margin for target identification at the given size and range.

The signal waveforms presented herein below in FIG. 14 for the decoys are for the following conditions:

(1) decoy size=1.7 ft (2) range=15 ft (3) separation between channel 1 and the auxiliary channel=5.5°.

Figure 14A:
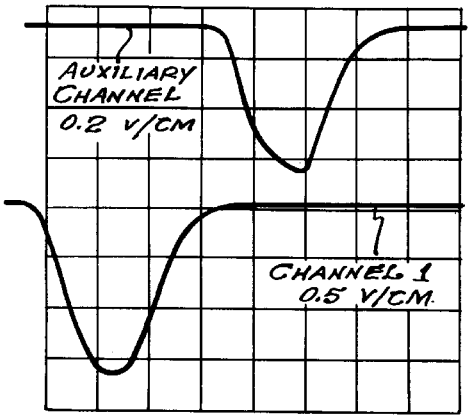
FIGS. 14A and 14B are a pair of graphs showing decoy input signal wave-forms for first and auxiliary channel spacing of five-and-one-half degrees.
Figure 14B:
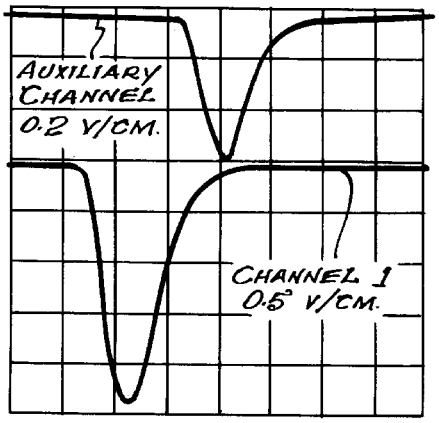

A marginal case was selected for decoys in order to illustrate the effects of closing velocity and detector response time. In FIG. 14*a* the decoy signal waveforms are for a closing velocity of 1000 ft/sec. Note that the trailing edge of the channel 1 signal approaches the leading edge of the auxiliary channel signal; however, there is no overlapping. When the velocity is increased to 1880 ft/sec., as seen in FIG. 14*b*, the overlapping between signals begins to appear, causing the decoy to be indicated as a target.

Figure 15A:
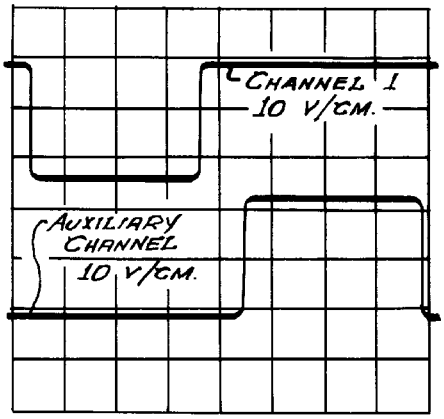
FIGS. 15A and 15B are a pair of graphs showing Schmitt trigger output signal waveforms for first and auxiliary channel spacing of five-and-one-half degrees.
Figure 15B:
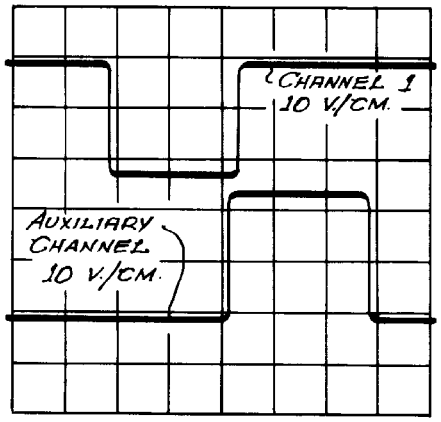

FIG. 15 displays decoy signal waveforms at the outputs of the Schmitt trigger circuits, 148 and 168 of FIGS. 10 and 11, for the corresponding decoy conditions shown in FIG. 14. Overlapping is seen to result for the closing velocity of 1880 ft/sec.

The results of the OSCCM intercept simulation tests are presented and discussed hereinbelow. The results for targets and decoys are discussed separately.

Three values of angular separation between channel 1 and the auxiliary channel were investigated, both for targets and decoys, i.e. 5.5°, 8°, and 10°. It was found that the best compromise for the angular separation was 8°. The results presented here are for the 8° case. The other parameters varied were: target size, range (or miss distance), closing velocity ($V_1$), and input signal amplitude. Input signal amplitude is defined here as the peak detector voltage, 141S and 161S of FIG. 11, at the input of the preamplifiers, 142 and 162 of FIGS. 10 and 11. Since the auxiliary channel input signal 161S was about 4 to 5 times lower than the input signal 141S in channel 1, signal amplitude reference was made with respect to the signal in the auxiliary channel. It was found that target identification effectiveness was degraded for low input signals, 141S and 161S. The results presented are for a target input signal of 100 mv which approximates the worst case situation. The intercept angle, the angle between the fuze axis and the closing velocity vector at intercept, was held at zero in all the tests (parallel intercepts).

Figure 16:
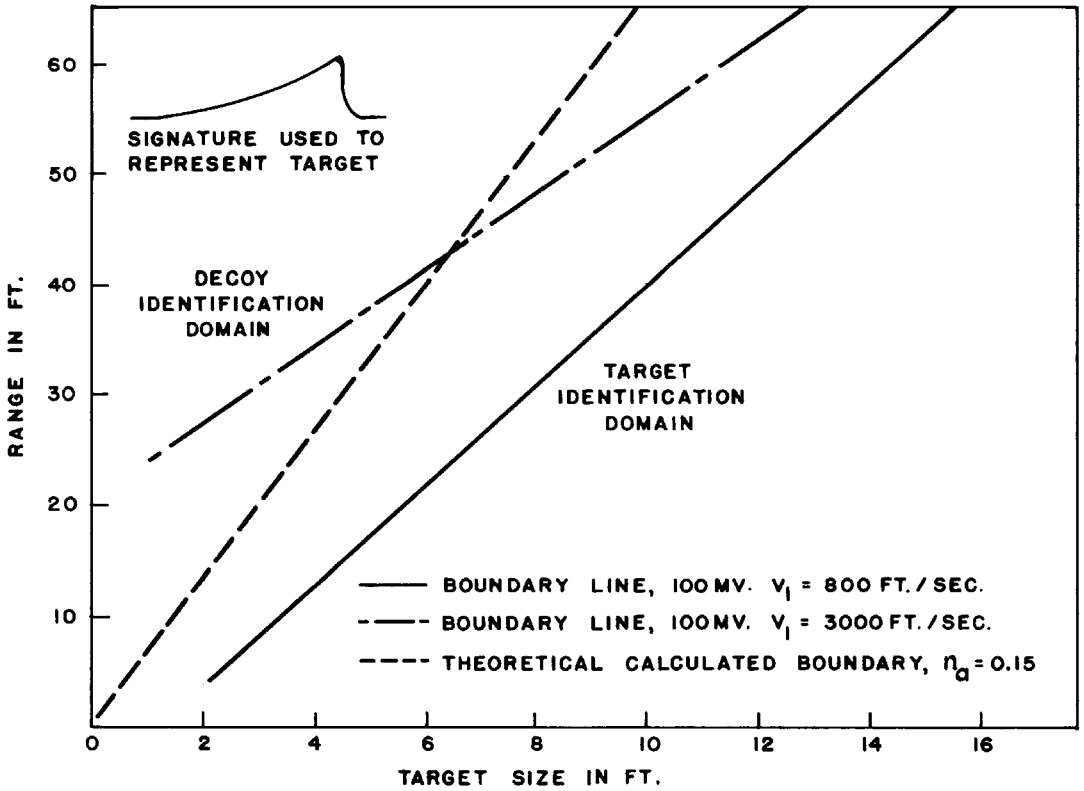
FIG. 16 is a graph showing OSCCM discrimination characteristics for target type signals.

The results for targets are summarized in FIG. 16. The diagram shows a range vs. target size domain which is subdivided into two parts by each of the three boundary lines, 172, 174 and 176. For each boundary line, the region above the line represents range and size combinations which the OSCCM system considers to be decoys and the region below each line is the target identification region. The uniformly dashed line 172 represents a calculated boundary line assuming 8° for the separation ($n_a$=0.15). In calculating this boundary, effects due to closing velocity, input signal amplitude, thresholds, field-of-view response characteristics, simulation set-up, etc. are completely ignored. The other two boundaries, 174 and 176, show the actual results obtained for closing velocities of 800 ft/sec and 3000 ft/sec, respectively. Note that there is a substantial separation between the lines for the two velocity values. The separation of the lines is largely due to the detector decay time constant which adds to the true signal length as the closing velocity increases. The boundary line 174 for 800 ft/sec is a substantial amount below the theoretical boundary principally because of signal duration loss due to a threshold in the circuitry. Since the input signal is 100 mv and the circuit threshold is set at 25–30 mv, an appreciable signal duration loss occurs, especially for the slowly rising signal used to represent the target. The value of the threshold, in a missile application, will depend upon background signal and noise considerations.

If a maximum miss distance for targets is considered to be 25 ft. then it can be seen from FIG. 16 that with the parameters shown, all targets larger than 6.7 ft. are properly identified by the OSCCM system.

Figure 17:
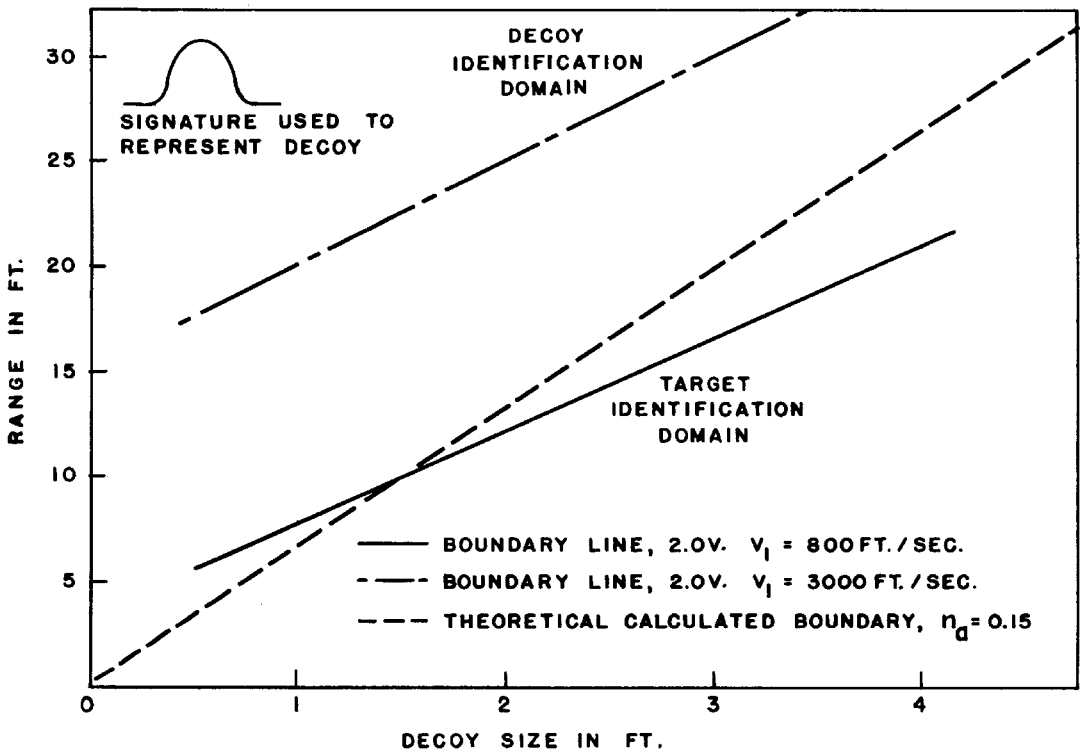
FIG. 17 is a graph showing OSCCM discrimination characteristics for decoy type signals.

The results of the evaluation tests for decoys are summarized in FIG. 17. The two boundary lines 184 and 186 shown are obtained for an input signal amplitude of 2 volts (maximum simulated amplitude). This was found to be the worst case for decoys because of the detector signal decay time constant effects.

The results presented in FIG. 17 are again only for the case of parallel intercepts. The regions above the boundary lines, 182, 184 and 186, as in FIG. 16, represent decoy conditions, and those below the lines target conditions, as identified by the OSCCM system. Again, considerable spread in the boundary lines, 182, 184 and 186, exists between the extreme closing velocity values. The difference becomes even more pronounced if one considers a fixed range, such as 20 ft., for example. At that range the system is capable of discriminating against decoys that have a signature from 1 ft. to about 3.7 ft. long, depending upon the closing velocity. The loss of discrimination effectiveness at high velocities is due to signal "stretching" (the $V_c\Delta t_p$ effect described in connection with Equation 6).

Figure 2:
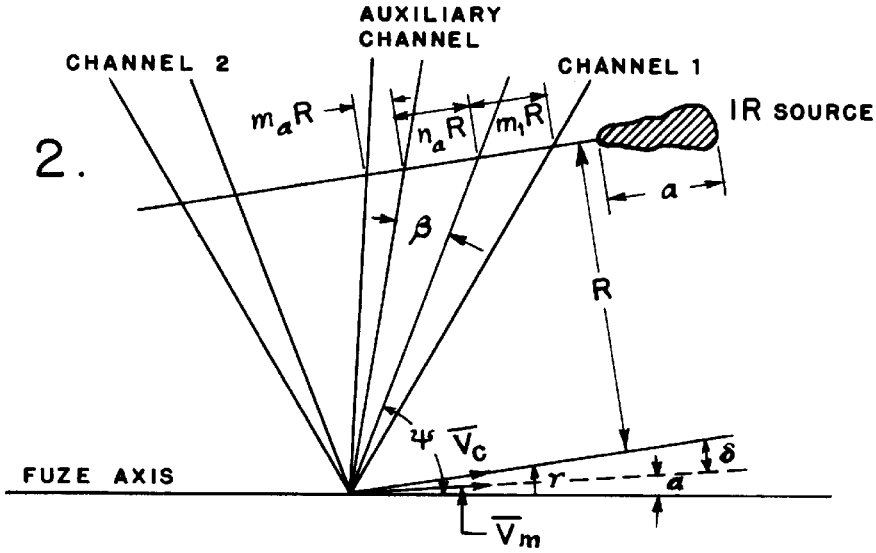
FIG. 2 is a diagram showing the fuze IR source intercept geometry for the overlapping signal counter countermeasure (OSSCM).

For the following derivation of the analysis of the effects of intercept angle, reference is directed to FIG. 2. The intercept angle γ can be considered as made up of two parts:

(1) the angle between the missile velocity vector and the closing velocity vector, which is a function of guidance intercept geometry, and (2) the missile angle of attack.

The intercept angle can vary over a wide range of values which are functions of the target's maneuvering capability and the launch tactics. The maximum excursion for γ is dependent upon the "application" and is difficult to estimate. The following equation can be written from the geometry of FIG. 2:

$$n_a R = R[\cot(\psi-\gamma)-\cot(\psi-\gamma+\beta)] \tag{26}$$

After sane manipulation the above equation can be put in the following form:

$$n_a = \frac{\sin\beta}{\sin(\psi-\gamma)\sin(\psi-\gamma+\beta)} \tag{27}$$

For parallel intercepts, γ=0°. If β=8° and ψ=70°, $n_a$=0.15. If γ is allowed to vary between sane limits (such as −15°≦γ≦15° or −30°≦γ≦30°), it is found that the maximum value for $n_a$ is obtained at the positive limits, +15° and +30°.

In order to insure that targets are still properly recognized at the worst value of γ, a reduction in separation, β, is necessary to keep the maximum value of $n_a$ from exceeding 0.15 when γ is varied between its specified limits. Thus, for example, if $$-15° \leqq \gamma \leqq +15°, \tag{28}$$

the required separation β may be obtained as follows:

$$0.15 = \frac{\sin\beta}{\sin(70°-15°)\sin(70°-15°+\beta)} \tag{29}$$

which yields $$\beta \approx 6.3°. \tag{30}$$

In a similar manner, if $$-30° \leqq \gamma \leqq +30°, \tag{31}$$

the separation is found to be $$\beta \approx 3.9° \tag{32}$$

It is seen therefore, that if γ is permitted to vary between −15° and +15°, the separation between channel 1 and the auxiliary channel must be reduced to 6.3° to guarantee the same target identification effectiveness which was obtained for the 8° separation case with γ=0°. In a similar manner, if the limits of γ are allowed to vary between −30° and +30°, the separation must be reduced to 3.9°. With the above reductions in separation, the effectiveness of the OSCCM system to decoy discrimination is reduced accordingly.

Figure 18:
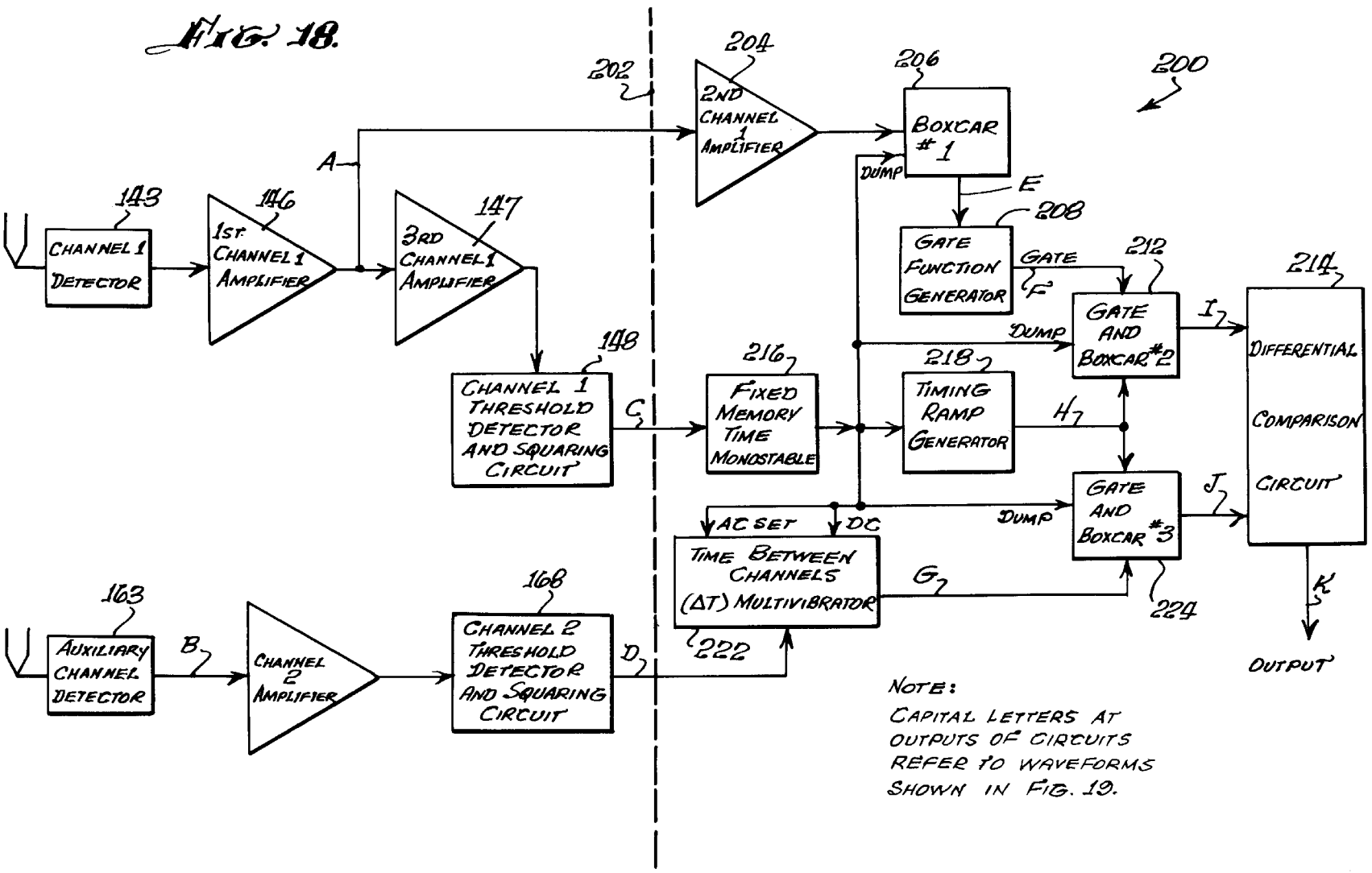
FIG. 18 is a block diagram of the time-to-peak modified overlapping signal counter countermeasure TTPOSCCM Ckt. No. 1.

A block diagram of the Time-to-Peak OSCCM (TTOSCCM) Ckt. No. 1 electronics 200 is shown in FIG. 18. Note the dashed line 202 drawn vertically and dividing the block diagram into two separate sections. The section to the left of the line 202 is basically the OSCCM circuit shown in FIG. 11, and has corresponding reference numerals. One exception is that the diode AND gate 154 shown in FIG. 11 is not used in the TTPOSCCM 200. The AND gate 154 is replaced with the signal processing circuits shown to the right of the dashed line.

These circuits to the right of the dashed line 202 have been designed to measure the time from the beginning (threshold level) of signal in channel 1 to the absolute peak i.e., highest voltage of that signal, and to compare that time to the time between thresholds in channel 1 and the auxiliary channel.

Figure 19:
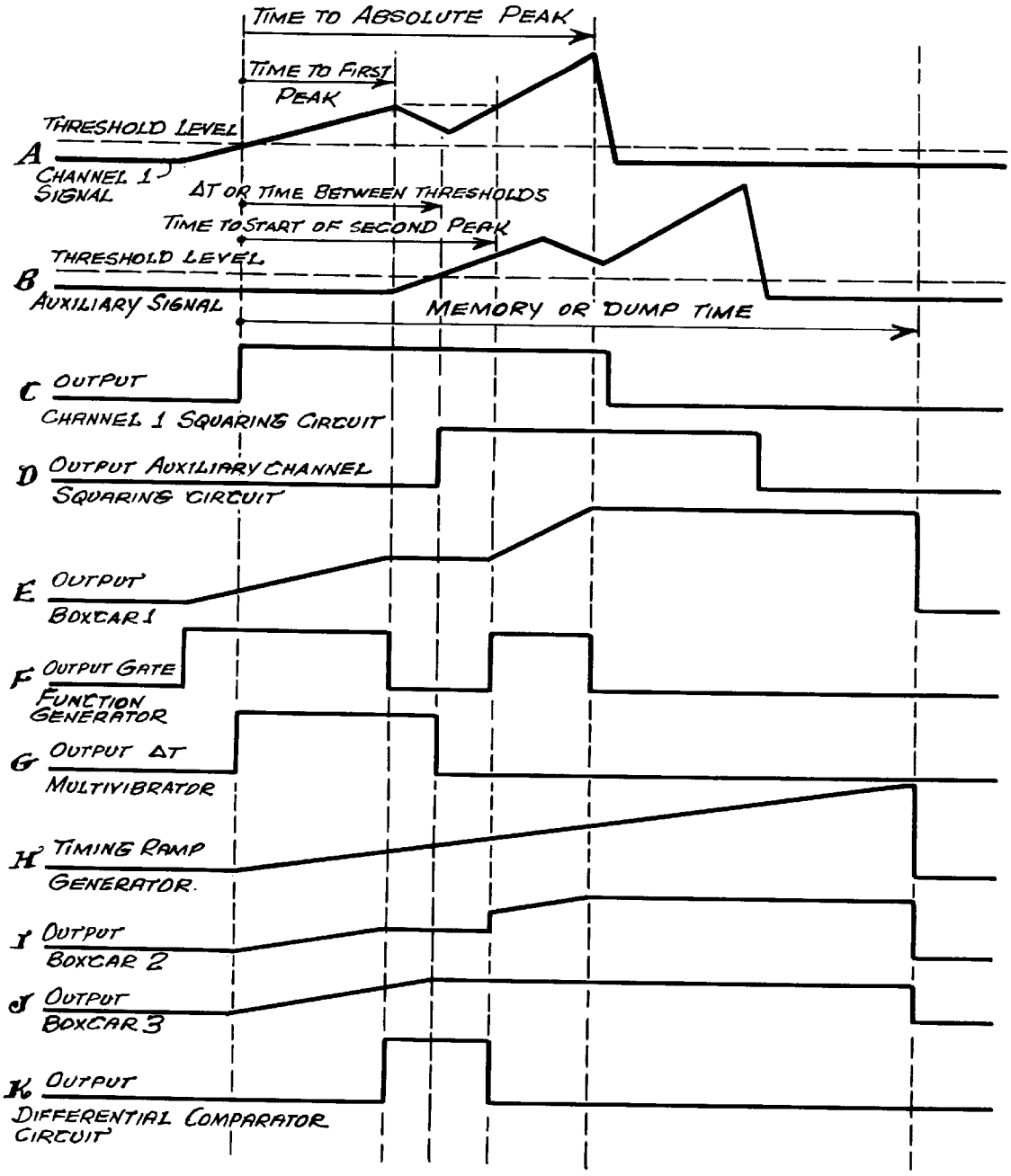
FIG. 19 is a set of graphs showing TTPOSCCM waveshapes.

FIG. 19 illustrates waveshapes at various points in the TTPOSCCM Ckt. No. 1. These waveshapes together with the block diagram of the circuit 200 shown in FIG. 18 will be used to help explain the operation of the circuits.

Three signal paths are shown crossing the dashed line into the signal processing section: a target signal, designated A, from the channel 1 detector 143, after amplification, waveshape A in FIG. 19 and the outputs C and D of the threshold and squaring circuits 148 and 168, after waveforms C and D in FIG. 19. Waveshape B is the auxiliary channel signal. The time between thresholds in waveshapes A and B is one of the times to be measured by the circuit 200. The following description pertains to the circuits on the right of the dashed line 202 in the block diagram, FIG. 18.

The channel 1 detector signal A is amplified and applied to boxcar #1, having reference numeral 206. This is a peak holding circuit whose output always reflects the peak value of its input. The output E of boxcar #1, 206,(from FIG. 19E) is applied to the gate function generator 208 which generates a gate voltage (FIG. 19F) only during the positive-going portion of its input. The trailing edges of these gate pulses, FIG. 19F, therefore occur simultaneously with the peaks of the channel 1 signal, FIG. 19A.

The ΔT multivibrator 222 is a flip-flop that is set, via the memory time monostable 216, by the leading edge of the channel 1 squaring circuit 148 output C (see FIG. 19C), and reset by the leading edge of the auxiliary channel squaring circuit 168 output (FIG. 19D). The ΔT multivibrator 222 output (FIG. 19G) therefore is a measure of the time between signal thresholds in the two channels. Waveforms F and G (FIG. 19) are subsequently used to gate the output, FIG. 19H, of a timing ramp generator 218 into boxcars #2 and #3, respectively, designated by numerals 212 and 214. The output of the timing ramp generator 218 is a voltage that is linearly proportional to time. It is initiated and reset by the memory time monostable 216. The outputs of boxcars #2 and #3 (FIG. 19, I & J) are voltages whose amplitudes are proportional to times $t_{max}$ and $t_1$, respectively, as shown in FIG. 9. These voltages are then compared in the differential comparison circuit 214, which essentially checks for the condition $t_{max}-t_1 \geqq 0$ (see Eq. 17 and FIG. 9).

The output of the comparison circuit 214 is shown in FIG. 19K. If the output I of boxcar #2, 212, at time $t_{max}$ is equal to or larger than the output J of boxcar #3, 224, at time $t_1$ (refer to FIG. 9), there is no output K from the comparator 214. This condition is defined as a target indication. If boxcar #3, 224, at time $t_1$ has an output voltage J greater than boxcar #2, 212, at time $t_{max}$, the comparator 214 produces an output voltage K. This condition is defined as a decoy indication. The momentary decoy indication shown in FIG. 19K is caused by the small peak in the channel 1 target waveshape, FIG. 19A, that occurs before the signal reaches the threshold level in the auxiliary channel. This does not interfere with circuit operation however because the comparator 214 output K is not used until the firing decision time. This decision is not made until later in the cycle (most probably in connection with the appearance of signal in channel 2).

Figures 20A, 20B, 20C:
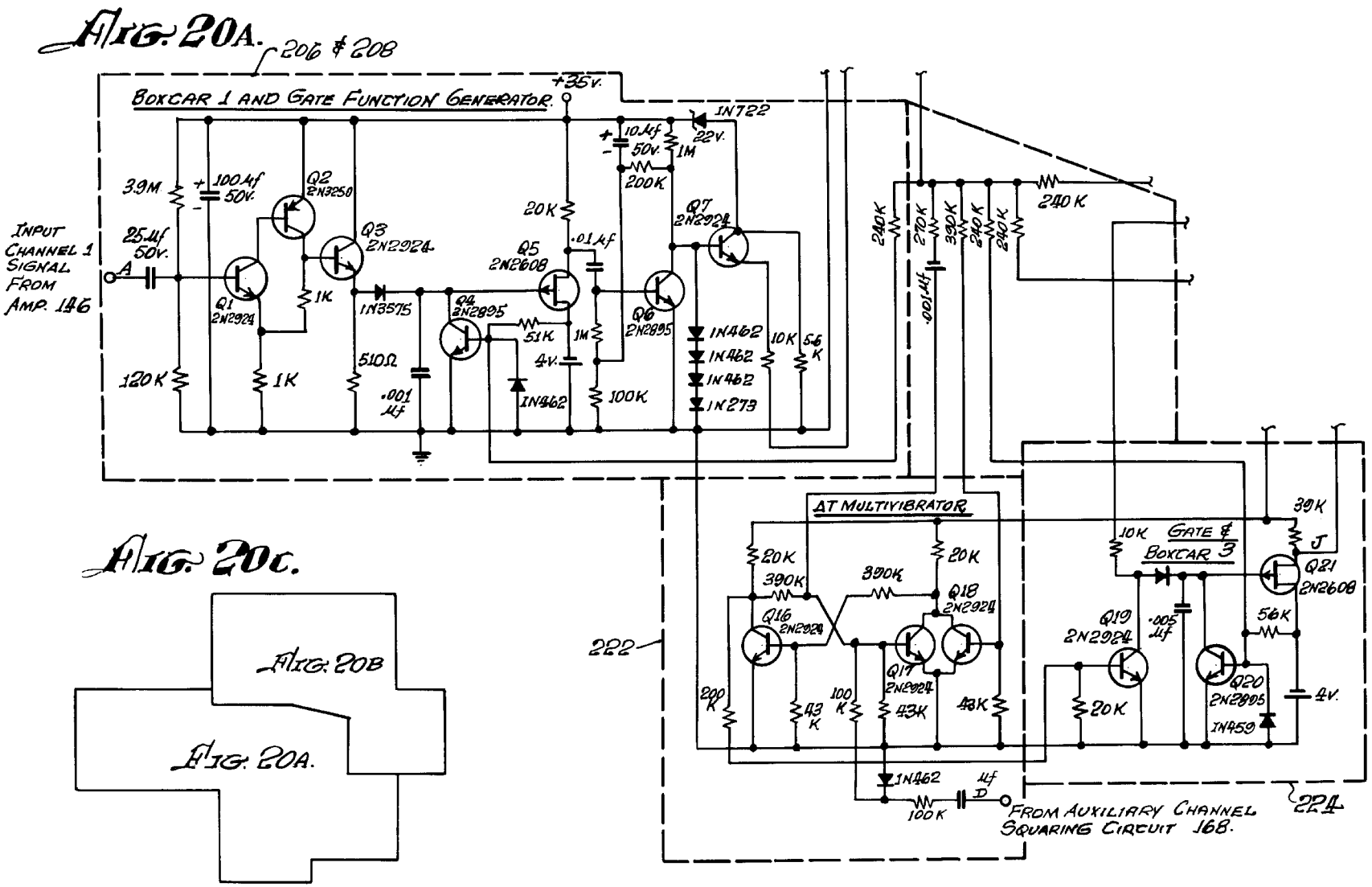
FIGS. 20A–20C are a pair of time-to-peak comparison circuit No. 1 for the TTPOSCCM system.
Figure 20B:
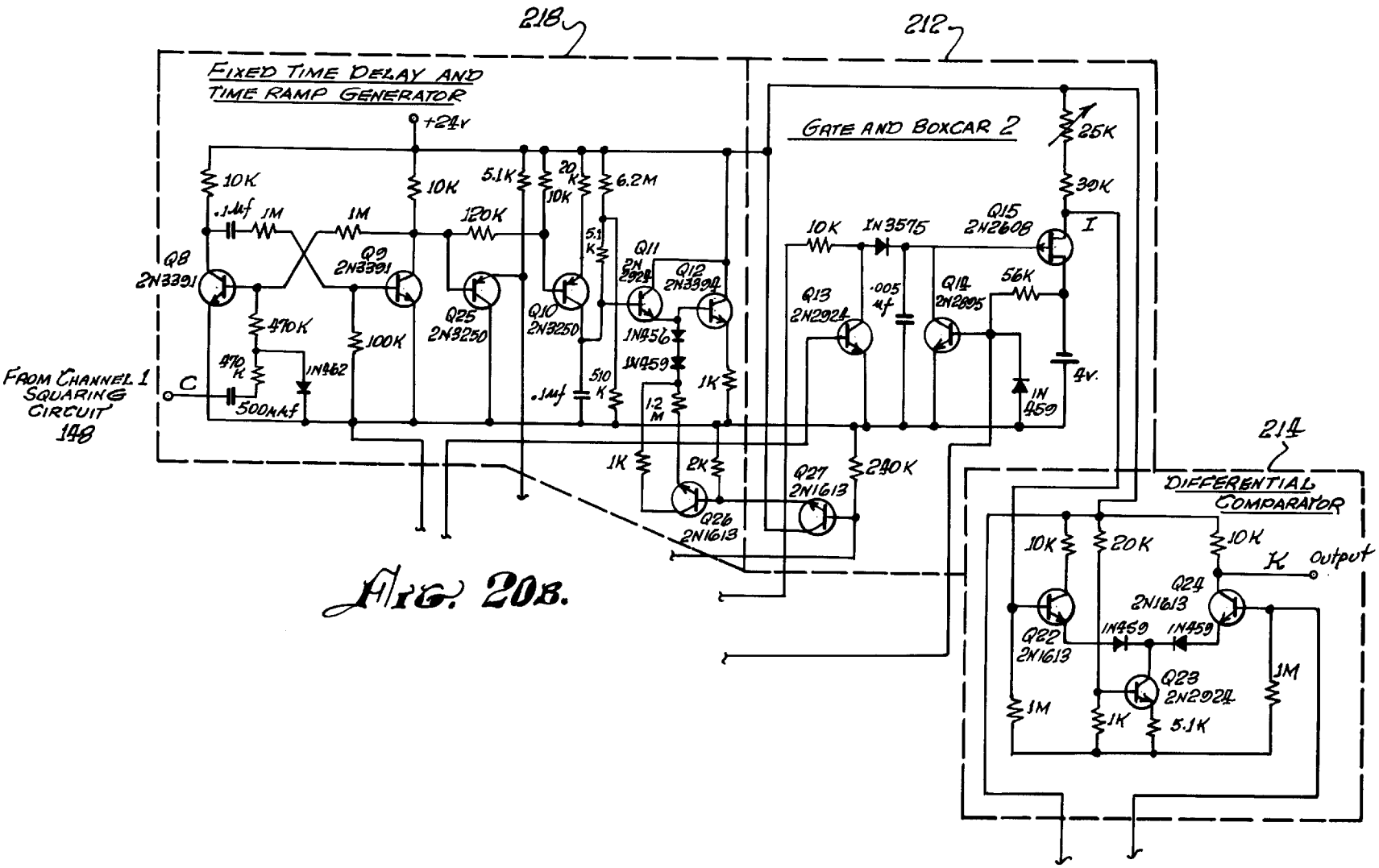

The memory time monostable 216 is used to dump, or clear,the boxcars 212 and 224 and to reset the time ramp generator 218 after a fixed memory time. If a multiple source problem is considered, such as a decoy preceding a target with both occuring during the memory time, it would be advantageous to incorporate a dump signal at the time of signal dropout in channel 1. This is done in circuit No. 2. The schematic diagram of the signal processing circuits for the TTPOSCCM Ckt. No. 1 is shown in FIG. 20, including the location of most of the waveforms of FIG. 19.

The target signal waveforms for the TTPOSCCM Ckt. No. 1 will now be discussed.

In order to illustrate the salient features of the time-to-peak circuits, a number of typical signal waveforms obtained at various points in the circuit are presented below. Three sets of pictures are shown in the next six figures, FIGS. 21 through 26:

(a) Multi-peak target, (b) single-peak decoy, and (c) two-peak decoy.

Figure 21A:
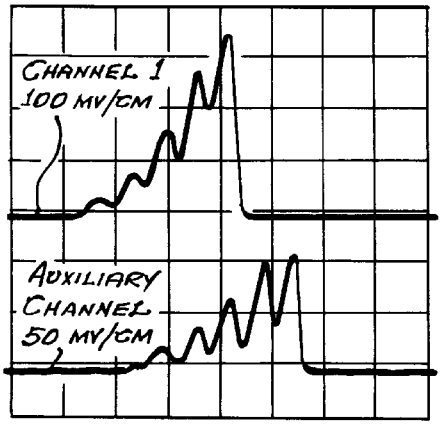
FIGS. 21A and 21B are a pair of graphs showing boxcar #1 and gate signal output waveforms of the TTPOSCCM circuit for a multi-peak target input.

FIG. 21*a* shows input signals from channel 1 and the auxiliary channel detectors 143 and 163, in FIGS. 10 and 18, for a multi-peak target 9 ft long at a miss distance of 15 ft and a closing velocity of 280 ft/sec. It is seen that the absolute peak of the target signal in channel 1 occurs near the end of the signal. At this point in time there is a considerable overlapping of signal in the auxiliary channel. Therefore, according to the logic of the TTPOSCCM circuit, this case should be clearly identified as a target.

Figure 21B:
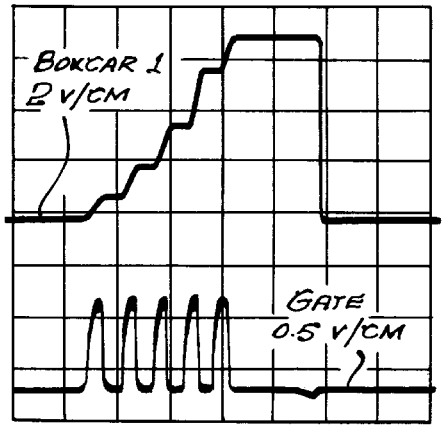

FIG. 21*b* portrays the signal waveforms corresponding to the outputs of boxcar #1 and the gate, 206 and 208, respectively, in FIGS. 18 and 20. The output of boxcar #1, 206, is seen to be derived from the input signal in channel 1 with the dips omitted, i.e. the output of boxcar #1 follows the rising portions of the input signals while holding the peak values of the signal until the next rising portion of the signal is encountered. At the end of a preset time, corresponding to a fixed memory time, this signal is dumped. The gate signal which is seen to be derived from the output of boxcar #1, 206, consists of positive pulses which are present only during the rising parts of the output of boxcar #1.

Figure 22A:
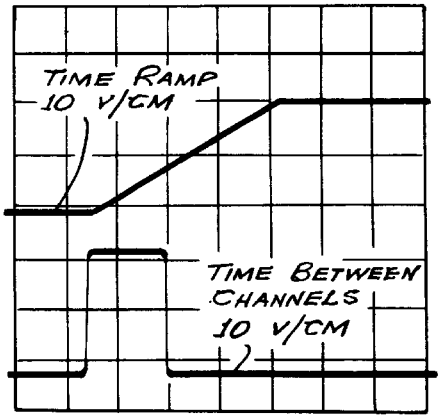
FIGS. 22A–22C are a set of graphs showing the time ramp, time between channels, Boxcar #2, boxcar #3, and comparator output signal waveforms of the TTPOSCCM circuit No. 1 for a multi-peak target.

FIG. 22 is a continuation of the same case as in FIG. 21. Part (a) shows a time ramp signal. The instantaneous voltage of the time ramp represents the elapsed time from the start of the signal in channel 1. The bottom signal in part (a) of FIG. 22 represents a gate signal which starts at the beginning of the signal in the auxiliary channel. Part (b) of FIG. 22 displays the output waveforms of boxcar #2, 212, FIG. 18, and boxcar #3, 224. The output of boxcar #3, 224, is a time ramp which has been gated by the bottom signal of FIG. 22*a*. The voltage of the output of boxcar #3, 224, thus represents the time interval between channel 1 and the auxiliary channel. The output of boxcar #2, 212, is the time ramp gated on and off by the gate signal shown in FIG. 21*b*. The output of boxcar #2, 212, is permitted to build up in a linear fashion during the "on" times of the gate signal while it is held constant during the "off" times. It is seen, therefore, that the final output voltage of boxcar #2, 212, represents the time interval from the start of the channel 1 signal to its absolute peak.

Figure 22B:
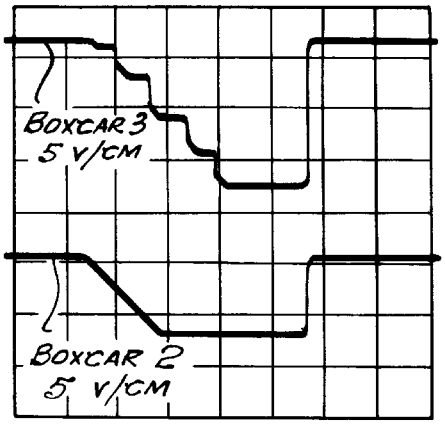
Figure 22C:
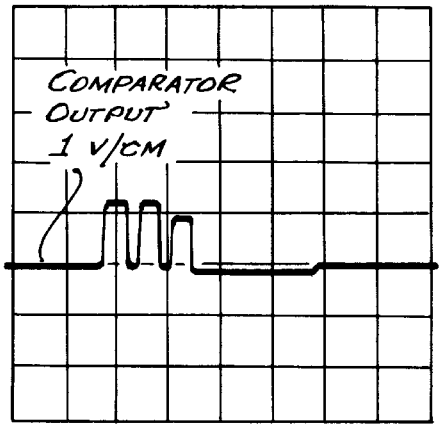

The two voltages shown in FIG. 22*b* are compared in a differential amplifier, 214 of FIG. 18, the output of which is seen in FIG. 22*c*. The three pulses represent conditions where the output of boxcar #2, 212, fell behind the output of boxcar #3, 224, i.e. those portions of the signal when the voltage indication of the time-to-peak interval fell below the voltage corresponding to the time between channels, thus indicating a decoy. Assuming that the decision of the time-to-peak circuit represented by the output of the differential amplifier (214 in FIG. 18) in FIG. 22*c* is checked after the signal in channel 1 expires, it is seen that a target indication is obtained. This check is made prior to the dump time, of course. There are several possibilities for the choice of this decision or check time:

(a) at the end of the channel 1 signal;

(b) a short time after the signal ends in channel 1;

(c) a fixed time after the start of the signal in channel 1 (Just prior to dump); and (d) at the end of the signal in the auxiliary channel.

Figure 23A:
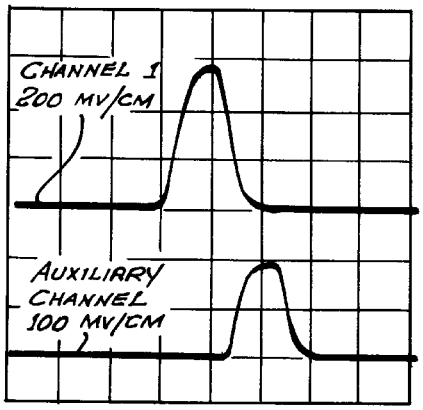
FIGS. 23A and 23B are a pair of graphs showing decoy input, boxcar #1, and gate signal waveforms of the TTPOSCCM circuit No. 1 for a single-peak decoy.
Figure 23B:
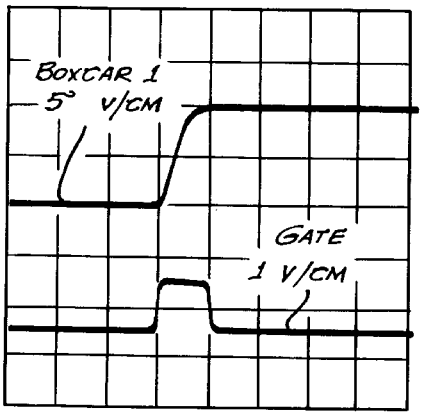
Figure 24A:
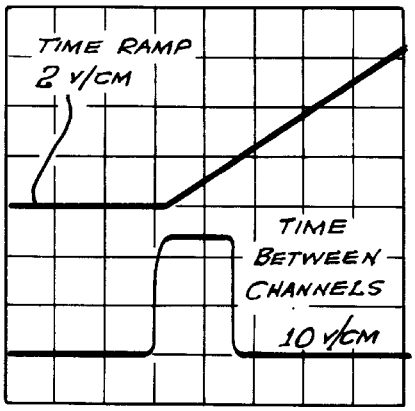
FIGS. 24A–24C are a set of graphs showing the time ramp, time between channels, boxcar #2, boxcar #3, and comparator output signal waveform of the TTPOSCCM circuit No. 1 for a single-peak decoy.
Figure 24B:
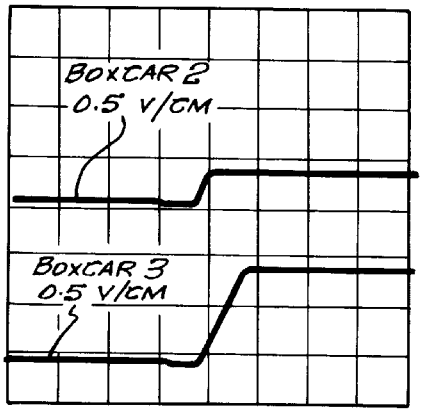

There are merits and drawbacks associated with each of the possibilities above. The alternative (c) was implemented in the simulation test reported in a section to follow;

Discussing now decoy signal waveforms for the TTPOSCCM Ckt. No. 1, FIGS. 23 and 24 illustrate the operation of the time-to-peak circuit when exposed to a single peak decoy signal. The decoy is 4 ft long and passes the fuze at a range of 18 ft, with a closing velocity of 2000 ft/sec. The input signals in channel 1 and in the auxiliary channel are shown in FIG. 23*a*. Note that the two signals overlap in time in the conventional (OSCCM) sense, i.e. there is a signal present in the auxiliary channel at the end of the signal in channel 1. Note, however, that there is no signal present in the auxiliary channel at the time of the peak of the signal in channel 1. Thus the logic of the TTPOSCCM circuit should indicate the presence of a decoy. FIG. 23*b* shows the output of boxcar 1 (206 in FIG. 18) and its corresponding gate signal. Only one pulse is present in the gate signal corresponding to a single peak before the absolute peak is encountered.

Figure 24C:
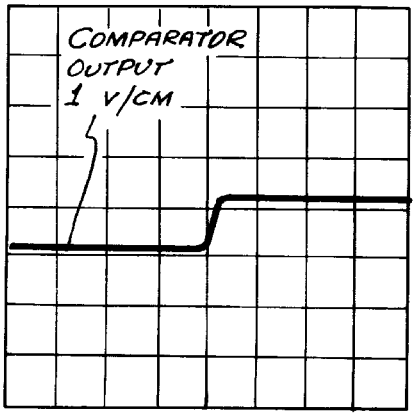

FIG. 24 shows the remaining signals for this case. Part (a) gives the basic time ramp signal and a gate signal corresponding to the time between channels. Part (b) shows voltage signals corresponding to the time between channels and the time to the absolute peak of the signal in channel 1 (boxcars #3, 224, and #2, 212, respectively, in FIG. 18). The decision as to whether a target or decoy is present is based on the signal shown in FIG. 24*c* with the upward or positive-going voltage indicating a decoy. In this case a decoy is indicated, assuming that the decision is made some time after the peak of the signal occurs in channel 1.

Figure 25A:
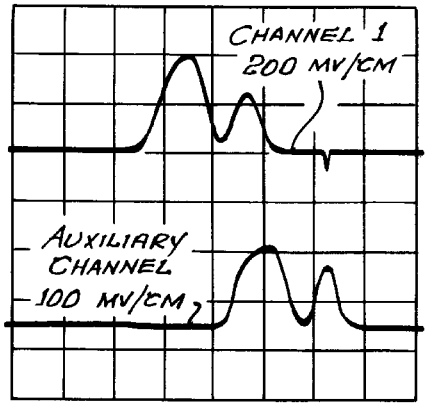
FIGS. 25A and 25B are a pair of graphs showing the decoy input, boxcar #1 and gate signal waveforms of the OSCCM circuit No. 1 for a two-peak decoy.
Figure 25B:
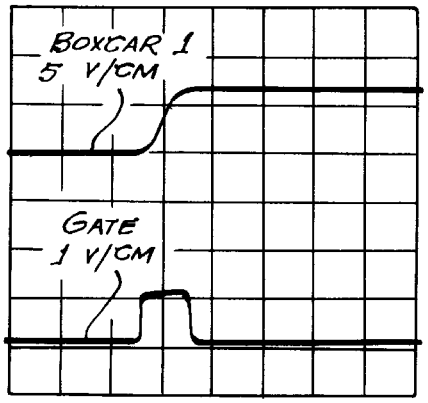
Figure 26A:
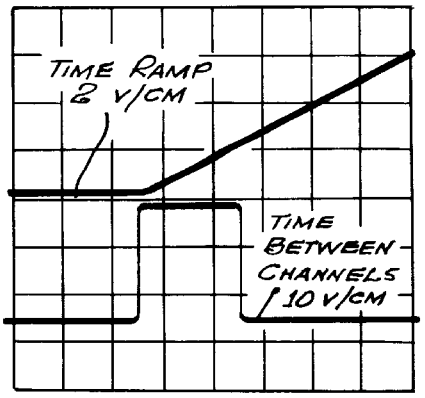
FIGS. 26A–26C are a set of graphs showing the time ramp, time between channels, boxcar #2, boxcar #3, and output signal waveforms of the TTPOSCCM circuit No. 1 for a two-peak decoy.
Figure 26B:
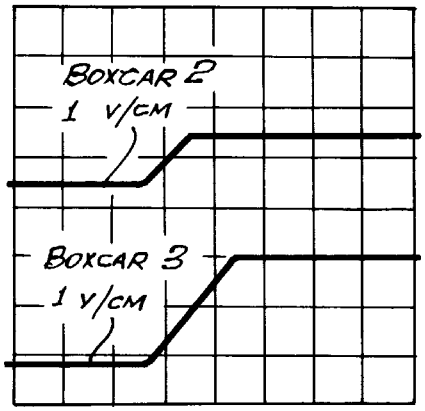
Figure 26C:
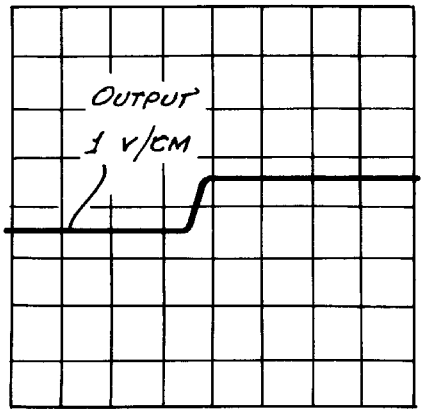

FIGS. 25 and 26 illustrate the performance of the TTPOSCCM system for a two-peak decoy signal with the first predominating. The signal could also be considered as being generated by two closely spaced decoys passing the fuze in succession. The decoy size corresponding to the overall length of the signal is 6 ft, the miss distance is 18 ft, and the closing velocity is 1500 ft/sec. A study of FIGS. 25 and 26 reveals that as far as the TTPOSCCM system is concerned this case is very similar to the previous one with a single peak signal. In fact, if one replaced the two-peak signal with a single peak signal the peak of which would coincide with the larger peak of the former, the performance of the rest of the circuitry would be identical. Note also that if the second peak were the larger of the two, the case would be identified as a target since the time-to-peak would then exceed the time between channels.

A summary and analysis of TTPOSCCM simulation results, Ckt. No. 1, will now be given.

The laboratory set-up and the procedures used for evaluation of the TTPOSCCM were very similar to those used for the OSCCM. It was mentioned previously that a very important parameter in decoy discrimination for the TTPOSCCM is the degree of decoy signal symmetry. It was stated that decoys with symmetrical signals, where the absolute peak of the signal occurs at or near the center of the signal, would be more effectively discriminated against by the TTPOSCCM than decoys with signals shaped like the target, i.e. with the absolute peak occuring near the end of the signal. In order to determine the boundary (or worst case) for decoy discrimination, decoys with target-like signals were simulated in all tests except one, which will be discussed later. Also, note that all the tests were performed with an 8° separation between channel 1 and the auxiliary channel.

First, the effects of input signal amplitude and closing velocity were investigated for parallel intercept cases. The results of these tests are displayed in FIG. 27. The abscissa represents the size of the object and the ordinate represents the perpendicular distance (minimum range) between the fuze and the object. There are four lines shown on the graph, each one corresponding to specified values of input signal amplitude and closing velocity. Only the extreme values of the closing velocity and the input signal amplitude were explored. The boundary values of the closing velocity (800 ft/sec and 300 ft/sec) are considered to be the extremes of the closing velocity distribution. The boundary values of the input signal amplitude (measured at the input of channel 1 of the TTPOSCCM circuitry) were selected to some extent because of system circuitry limitations, i.e. saturation of signal occurs in channel 1 when the input signal exceeds 2 volts. The low value of input signal amplitude (100 millivolts) is considered to correspond approximately to that of the minimum target at maximum miss distance. In these tests the amplitudes of the input signals in channel 1 and in the auxiliary channel were adjusted to the same level.

Figure 27:
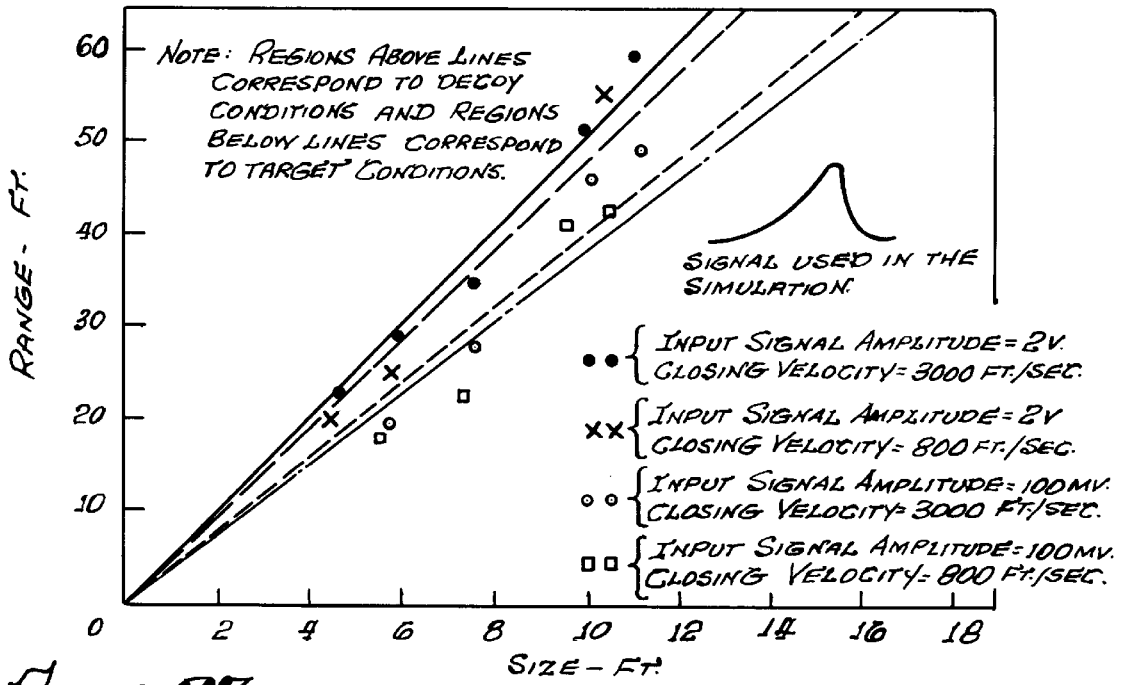
FIG. 27 is a set of graphs showing the discrimination characteristics of the TTPOSCCM Ckt. No. 1 as a function of closing velocity and input signal amplitude.

The four lines plotted in FIG. 27 represent the boundary conditions of the TTPOSCCM Ckt. No. 1 discrimination characteristics for the corresponding input signal amplitude and closing velocity values. In each case, the region above the line (or to the left) indicates all the combinations of ranges and sizes of objects which would be evaluated at decoys by the TTPOSCCM, and the region below the line (or to the right) represents all the combinations of ranges and sizes of objects which would be considered as targets.

It is to be noted that only relatively minor variations in the boundary lines exist between the extreme values of the closing velocity for a constant input signal amplitude. On the other hand, the changes in the boundary lines due to the extreme variations in input signal amplitude at a constant closing velocity are somewhat more pronounced. These variations are strictly due to thresholds. The thresholds effect cannot be eliminated and, therefore, a region of transition between the target and decoy zones will always exist. In this transition zone the system may identify a given object as a target or a decoy depending upon the values of the input signal amplitude and the closing velocity.

(S) It can be seen from FIG. 27 that, at a miss distance of 25 ft, the system correctly recognizes a target of about 7 ft or more in size. Also, at the same miss distance, the system is capable of recognizing a decoy of about 5 ft or less in size. The transition zone at this miss distance extends over about 2 ft. Note also that at a miss distance of 10 ft, the system is still able to recognize decoys of up to 2 ft in size. The above results are for the case of parallel intercepts. If the intercept angle deviates from zero, some degradation of target identification takes place, as discussed next.

(C) Tests were performed to investigate the extent to which non-parallel intercepts affect the performance of the TTPOSCCM circuit No. 1. The intercept angle, $\gamma$, is defined here as the angle between the closing velocity vector and the fuze axis (see FIG. 2). It can be observed in FIG. 2 that if $\gamma$ is increased, the separation distance, $n_aR$, between channel 1 and the auxiliary channel also increases. The maximum allowable value for $n_aR$ must be compatible with the minimum target size at maximum miss distance.

Figure 28:
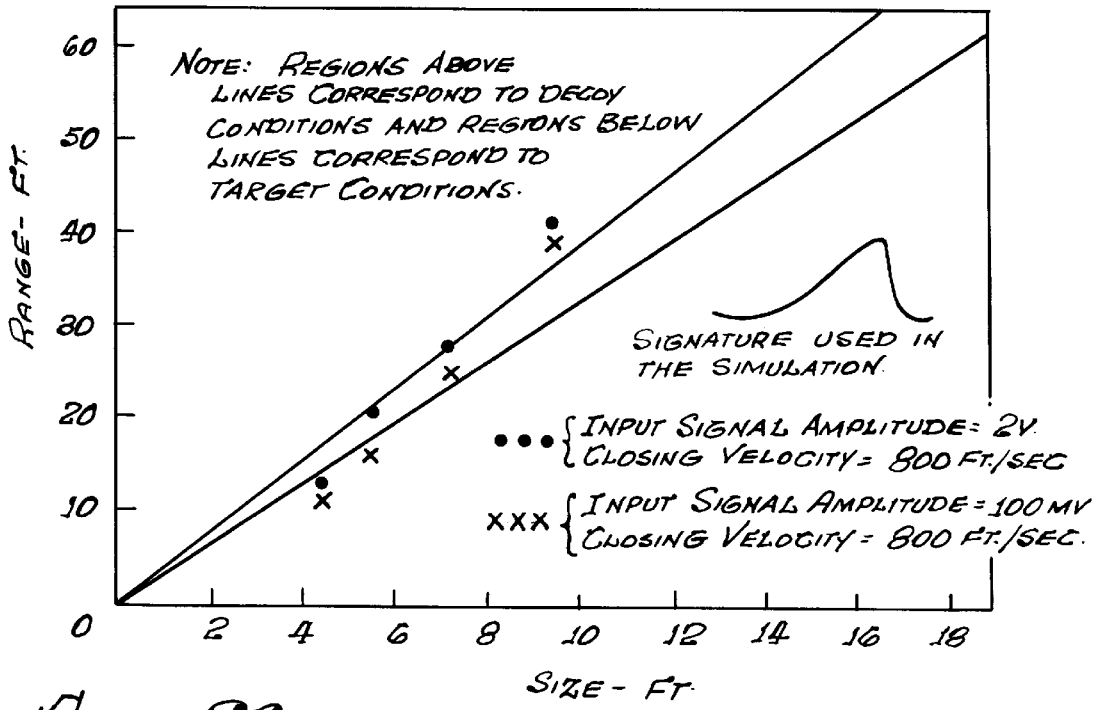
FIG. 28 is a pair of graphs showing the discrimination characteristic of the TTPOSCCM Ckt. No. 1 for 15° intercept.

(S) The results obtained for the case of $\gamma=15°$ are shown in FIG. 28. Since the excursions of the boundary lines due to closing velocity variations are small compared to the input signal voltage variation effects, only the latter are shown in the graph. Comparing FIG. 28 with FIG. 27, it is seen that the boundary lines have rotated somewhat clockwise, reducing the target zone. For example, at a miss distance of 25 ft, targets of approximately 8 ft in size or larger can be identified correctly. For the parallel intercept case, the minimum target size was 7 ft. Conversely, the decoy zone has expanded, allowing larger decoys to be identified. The worst case for decoy identification occurs when $\gamma$ goes negative, i.e. when $n_aR$ is minimum. However, the change in $n_aR$ in going from $\gamma=0°$ to $\gamma=-15°$ is small compared to that from $\gamma=0°$ to $\gamma=+15°$. In can, therefore, be assumed that the extreme left boundary in FIG. 27 will not change significantly for $\gamma=-15°$.

Figure 29:
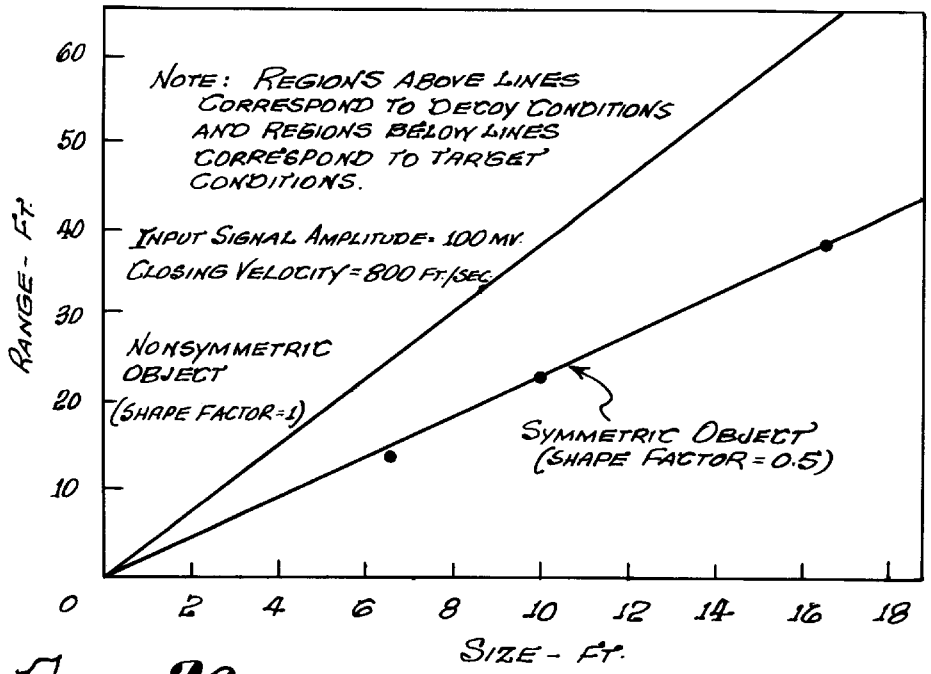
FIG. 29 is a pair of graphs showing the discrimination characteristic of the TTPOSCCM Ckt. No. 1 as a function of object symmetry.

The results reported above were obtained for objects shaped in such a manner as to produce waveforms that peaked near the end of the signal. It was of interest to determine how much improvement in decoy identification would result for the case of symmetrical decoys, i.e. decoys that produced waveforms whose maximum peak occurred at or near the center of the signal. The results obtained are shown in FIG. 29. It is seen that a very pronounced improvement in decoy discrimination results for a symmetrical decoy as compared to a nonsymmetrical one. Since the nonsymmetrical case for the decoys (where a decoy resembles a target in shape) is the worst case, the TTPOSCCM will give somewhat better performance than is indicated by the boundary line on the left in FIG. 29. The degree of symmetry of the decoys will determine the actual amount of improvement in discrimination.

(S) It is of interest to make a comparison of the results for the two versions of the OSCCM system to determine what is gained by the addition of the complicated time-to-peak signal processing circuits. The comparison, shown in FIG. 30, was accomplished by using target-type signatures(shape factors≈1) for locating the TTPOSCCM boundary, and decoy-type signatures (shape factors≈0.5) for locating the 2 OSCCM boundaries.

The OSCCM target-decoy discrimination characteristics are significantly effected by intercept velocity, therefore, two boundary lines are shown for this circuit: one for 800 ft/sec and one for 3000 ft/sec. The TTPOSCCM target-decoy discrimination characteristics are not effected appreciably by intercept velocity, therefore, only one boundary line is shown for this circuit. The two boundary lines for the OSCCM have been extrapolated from previous data and, therefore, the extrapolated portions should be regarded only as approximations.

Figure 30:
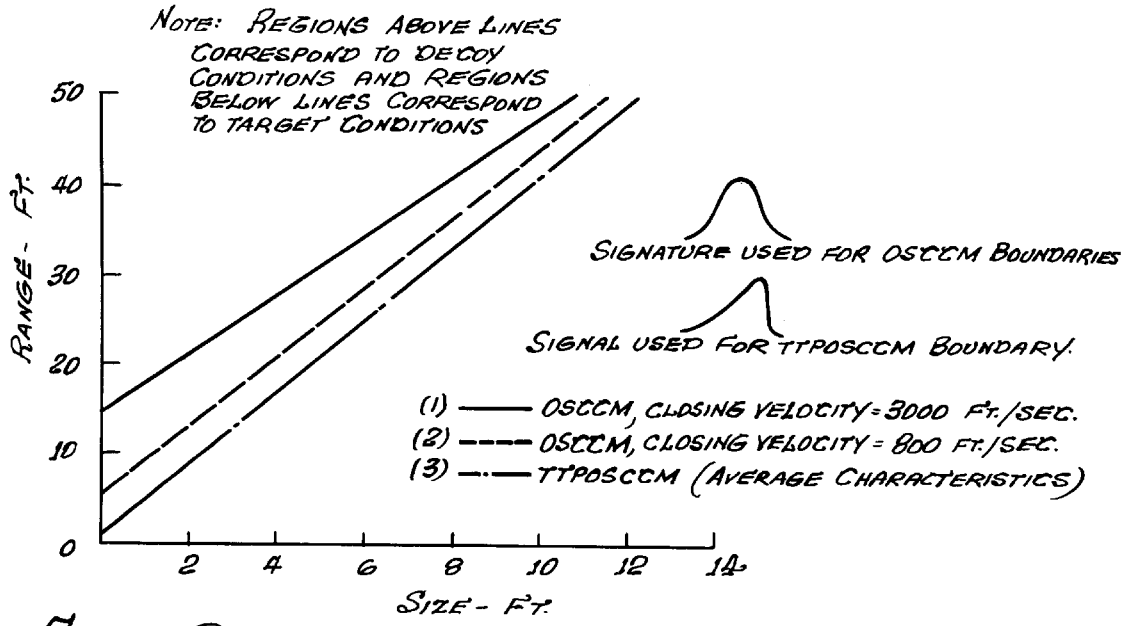
FIG. 30 is a set of graphs showing the comparison of the discrimination characteristics of the OSCCM and the TTPOSCCM Ckt. No. 1.

An attempt to take into account the effects of range on signal amplitude has been made in FIG. 30 by constructing the boundary between the target and decoy identification domains using high amplitude (2 volt) data points for the short ranges and low amplitude (100 mv) data points for the long ranges for all three curves.

Inspection of FIG. 30 reveals that the two systems have approximately the same size vs. range domains for reliable target detection (the area to the right and under line (2) for the OSCCM and line (3) for the TTPOSCCM). However, the TTPOSCCM has a larger domain for reliable decoy discrimination (the area to the left and above line (1) for the OSCCM and line (3) for the TTPOSCCM).

The comparison shown in FIG. 30 would have been even more favorable for the TTPOSCCM if target-type signatures (shape factor≈1) had been used for the location of the 3000 ft/sec boundary line for the OSCCM as a "worst case" decoy. The 3000 ft/sec OSCCM boundary line for decoys with target-type signatures would intersect the range axis at approximately 25 ft and run parallel or near parallel to the other boundary lines shown.

The circuit for the TTPOSCCM shown in FIG. 20, Ckt. No. 1, was designed to be used in the laboratory to evaluate the time-to-peak concepts.

The series of simulations performed with the TTPOSCCM Ckt. No. 1 indicated that certain sub-circuits of the overall circuit could be improved. A re-design was performed resulting in TTPOSCCM Circuit No. 2, shown in FIG. 31. Other improvements were incorporated into the re-designed circuit to make it better suited to a realistic missile application. Circuit No. 2 is improved in the following areas:

(1) smaller volume;

(2) higher dynamic range before saturating in the time-to-peak channel;

(3) better dv/dt resolution for the gate function generator;

(4) improved signal processing for multiple source encounters;

(5) better rejection of sun signals; and (6) quadrant detection capability.

A considerable amount of work has been directed toward minimizing the effects of very large sun signals which may be caused by the sun passing through the field of view during pitch or yaw motions. Sun signals have been measured with an optical unit from an AIM 9D missile fuze to determine their shape and order of magnitude. Signals which very closely approximate the measured sun signals have been synthesized on an EXACT-200 waveform synthesizer and passed into the amplifiers and level detectors of the TTPOSCCM. Amplifier transient response can cause these signals to generate secondary level crossings at the Schmitt triggers after the sun has passed through the field of view. These secondary signals would adversely effect the system performance, possibly to the extent of generating a target-like signal in beam 1 and the auxiliary beam. The tests performed with these synthesized sun signals have indicated the transfer characteristics and compensating networks necessary to eliminate this secondary level detection.

The new circuits incorporate quadrant detection capability which makes the fuze capable of firing an aimable warhead. This feature adds to the complexity of the system but may easily be eliminated if so desired.

Figure 31:
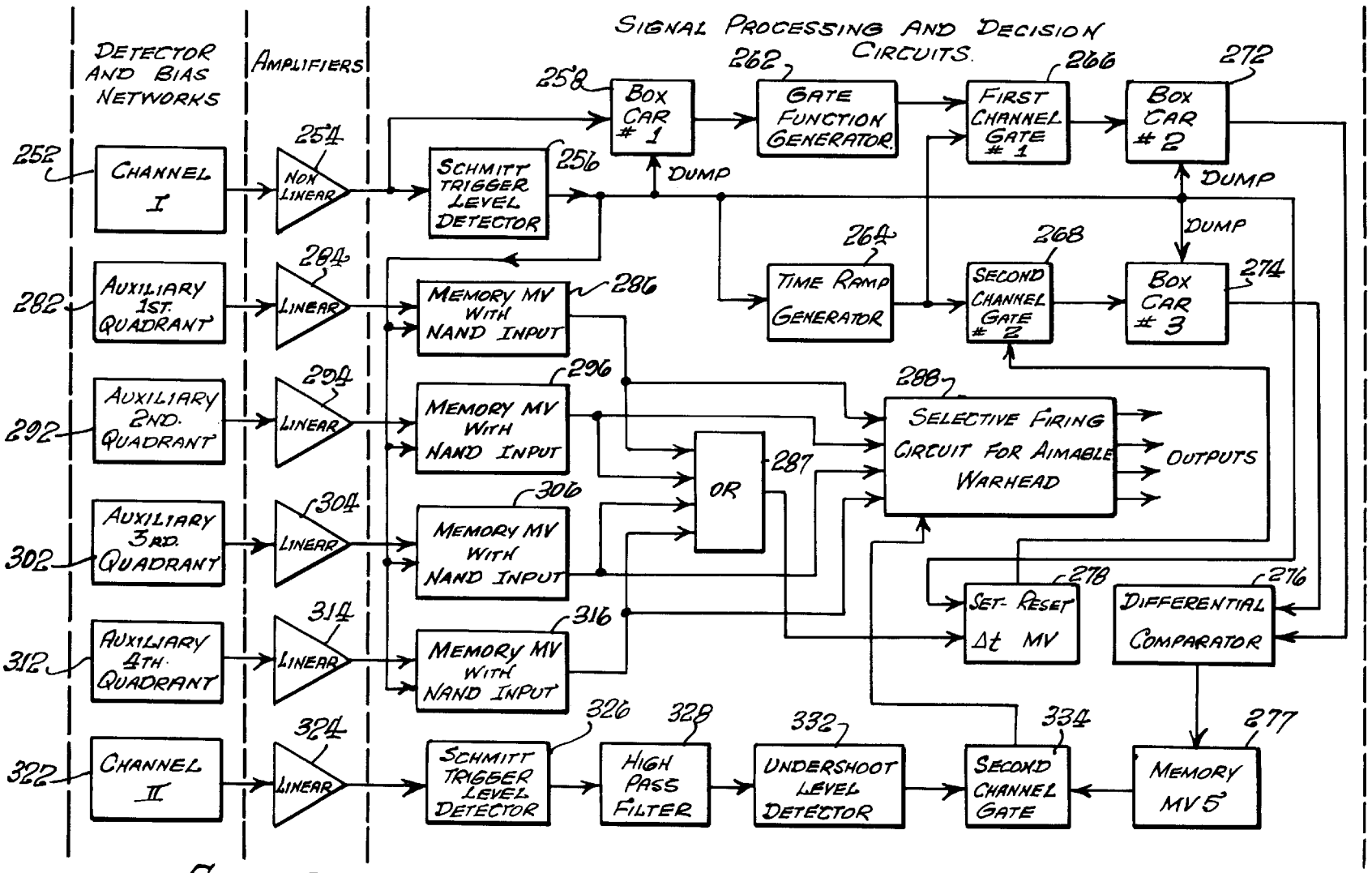
FIG. 31 is a block diagram for the TTPOSCCM Ckt. No. 2 with quadrant detection.

FIG. 31 is a block diagram of the TTPOSCCM Circuit No. 2. The basic principles of the time-to-peak circuits are the same as previously discussed. One difference is that the channel 1 Schmitt level detector 256 output dumps, or clears, the boxcar circuits 258, 272 and 274, and resets the time ramp generator 264 immediately upon loss of signal in channel 1. This results in improved performance for multiple source intercepts. The memory MV circuits, 286, 296, 306 and 316, following the auxiliary channel quadrant amplifiers, 284, 294, 304 and 314, serve as level detectors and "remember" which of the auxiliary channels received a signal during the intercept. A NAND circuit at the input of the memory MV 286, 296, 306 and 316, allows only those auxiliary signals occuring during the presence of channel 1, 252, signals to pass into the memory multivibrators. The fifth memory MV 277, after the differential comparison circuit 276, stores either a target or decoy signal for a fixed time depending upon whether or not the time-to-peak overlapping conditions are met during the intercept. The high pass filter 328 and undershoot level detector 332 fix a minimum signal persistence time for signals in channel 2, and send a pulse into the following, second channel gate 334 at the end of the channel 2 signal, if the minimum signal time duration is exceeded. This pulse is passed through the gate 334 and into the selective firing circuit 288 if the time-to-peak processing circuits indicate a target. The selective firing circuit 288 "aims" the warhead into the quadrant which received signals during the intercept.

Figure 32A:
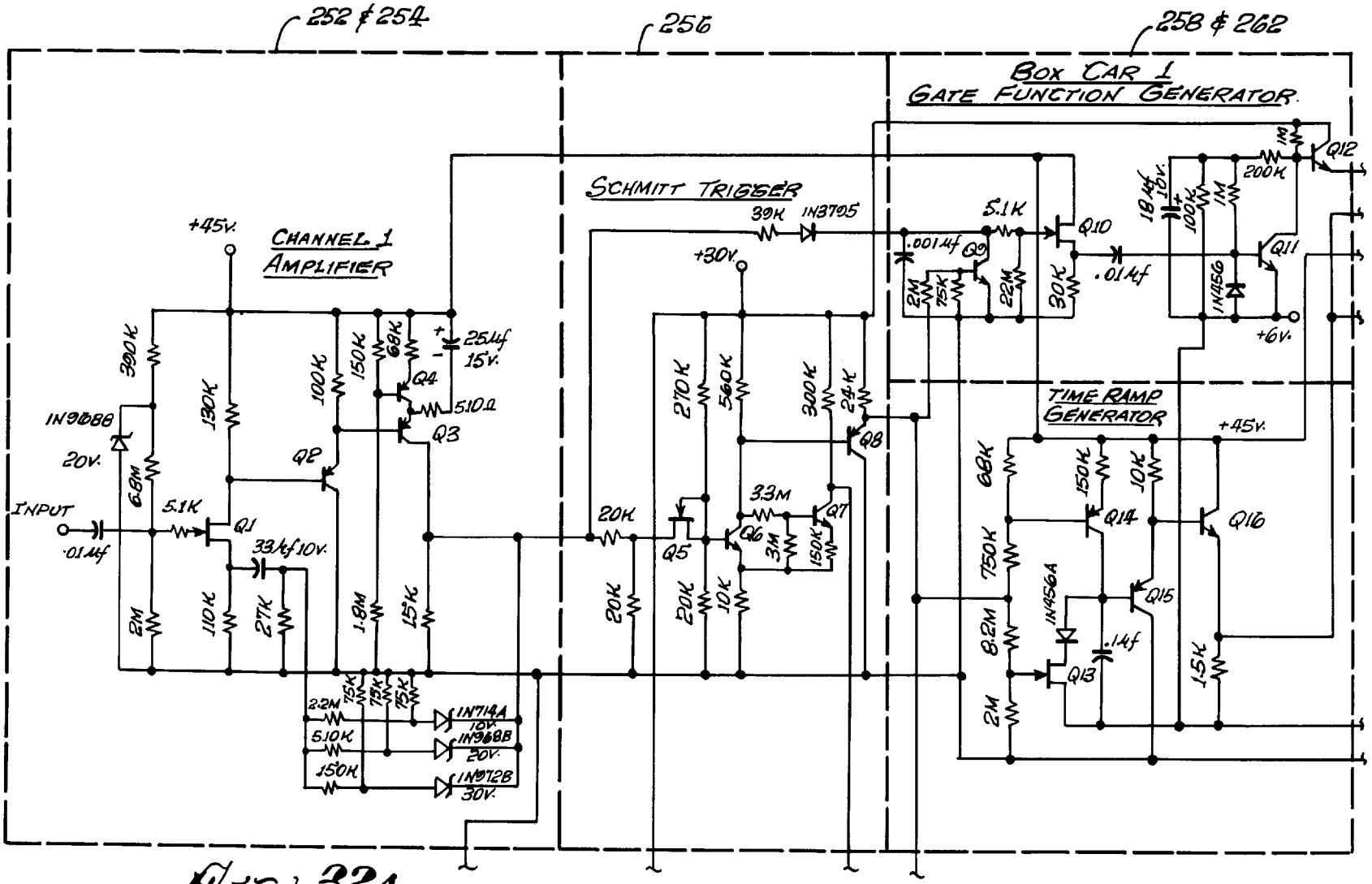
Figure 32B:
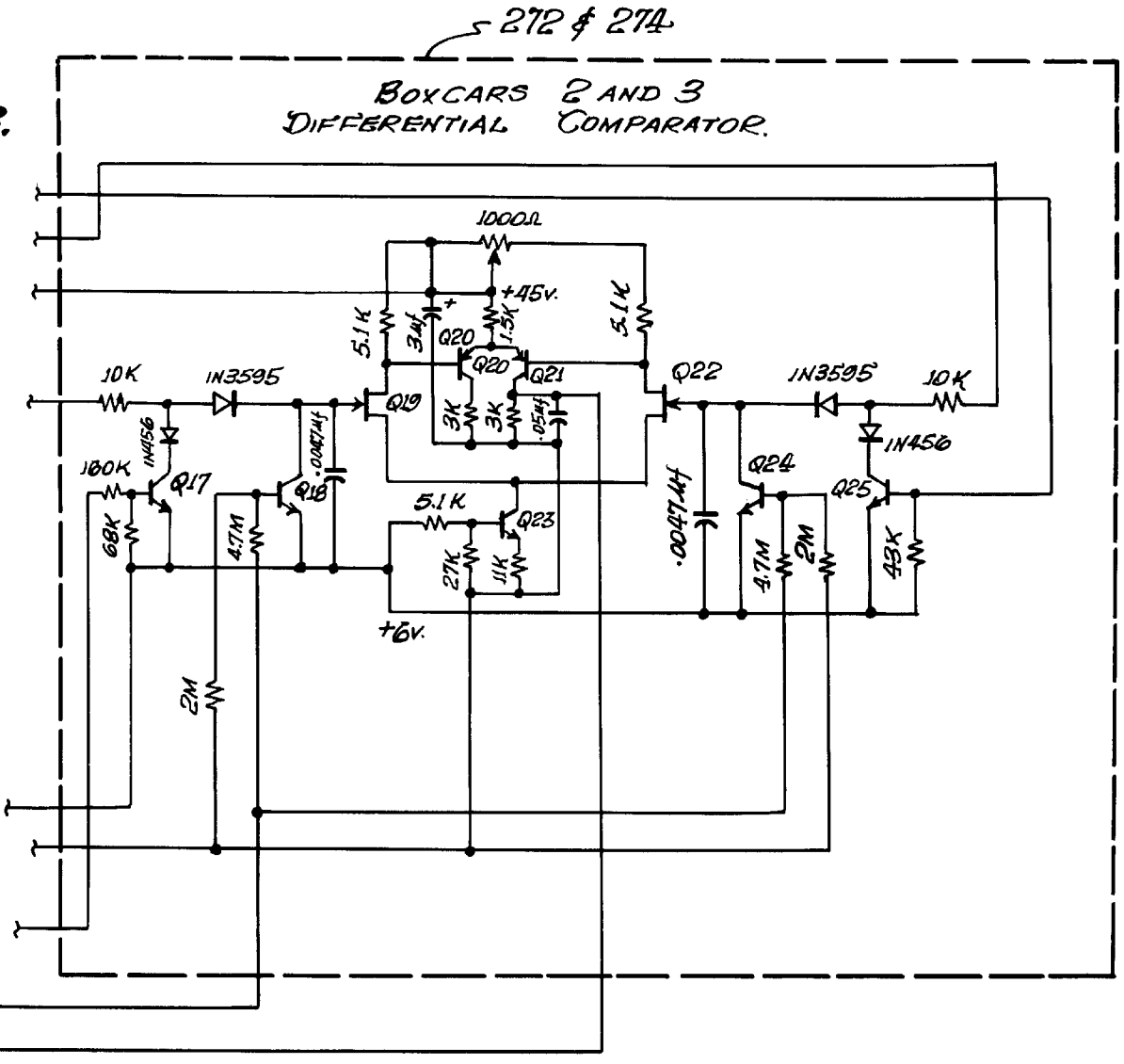
Figures 32C, 32D:
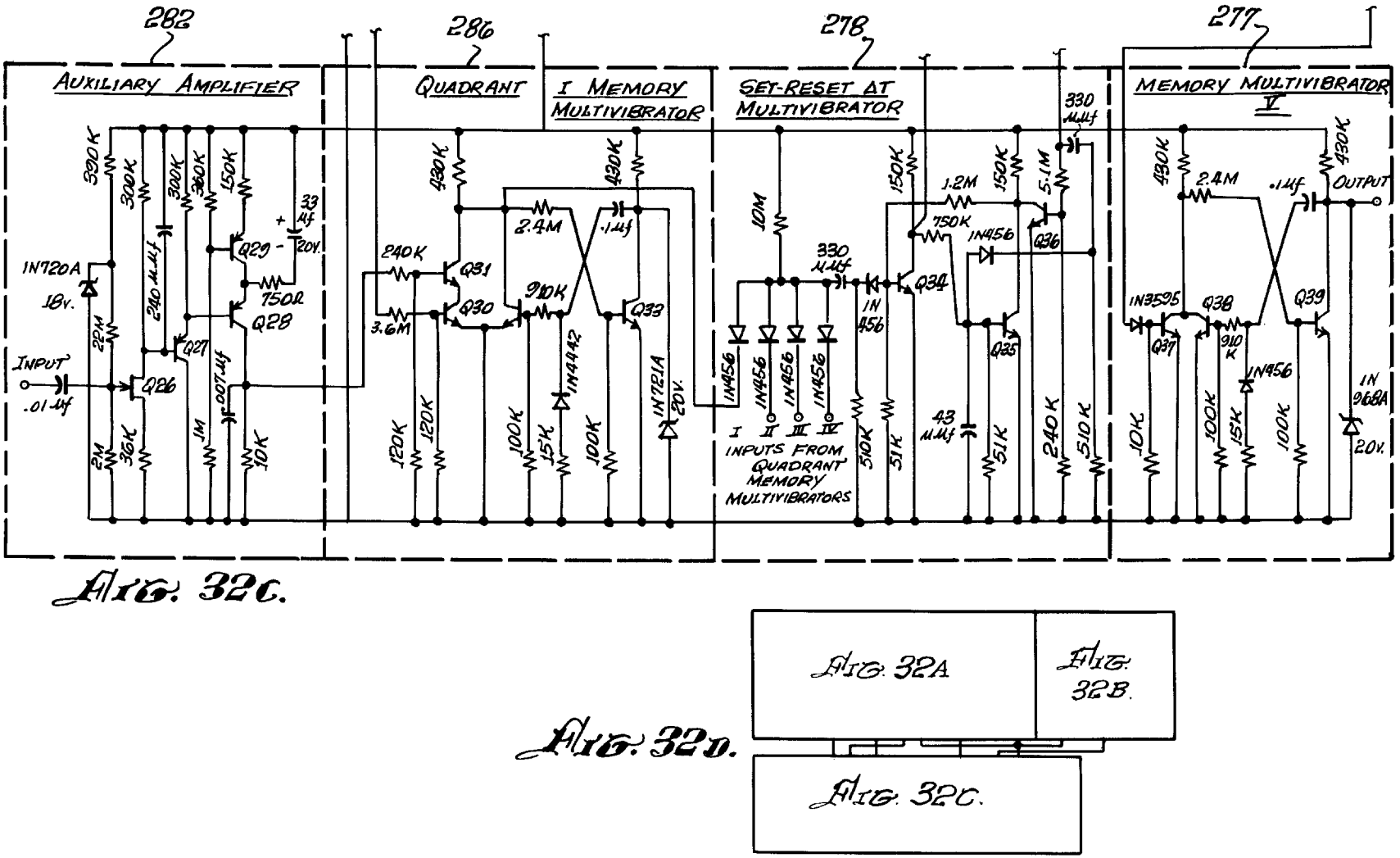

FIG. 32 is the schematic of the electronics for the TTPOSCCM (Ckt. No. 2) with quadrant detection. This schematic includes all the electronics necessary for channel 1, one of the auxiliary beam quadrants, the first, and all of the processing and decision making circuits. The schematic does not include the circuits of channel 2 or the other three auxiliary beam quadrant amplifiers, or the burst timing circuits. Many of the circuits are designed so that dual transistors may be used to save space and lower the component count. The circuit could also be mechanized in a very small volume by using a combination of integrated circuits, miniature discrete components, and film resistor modules. The power requirement for this circuit is approximately 352 milliwatts.

Figure 33:
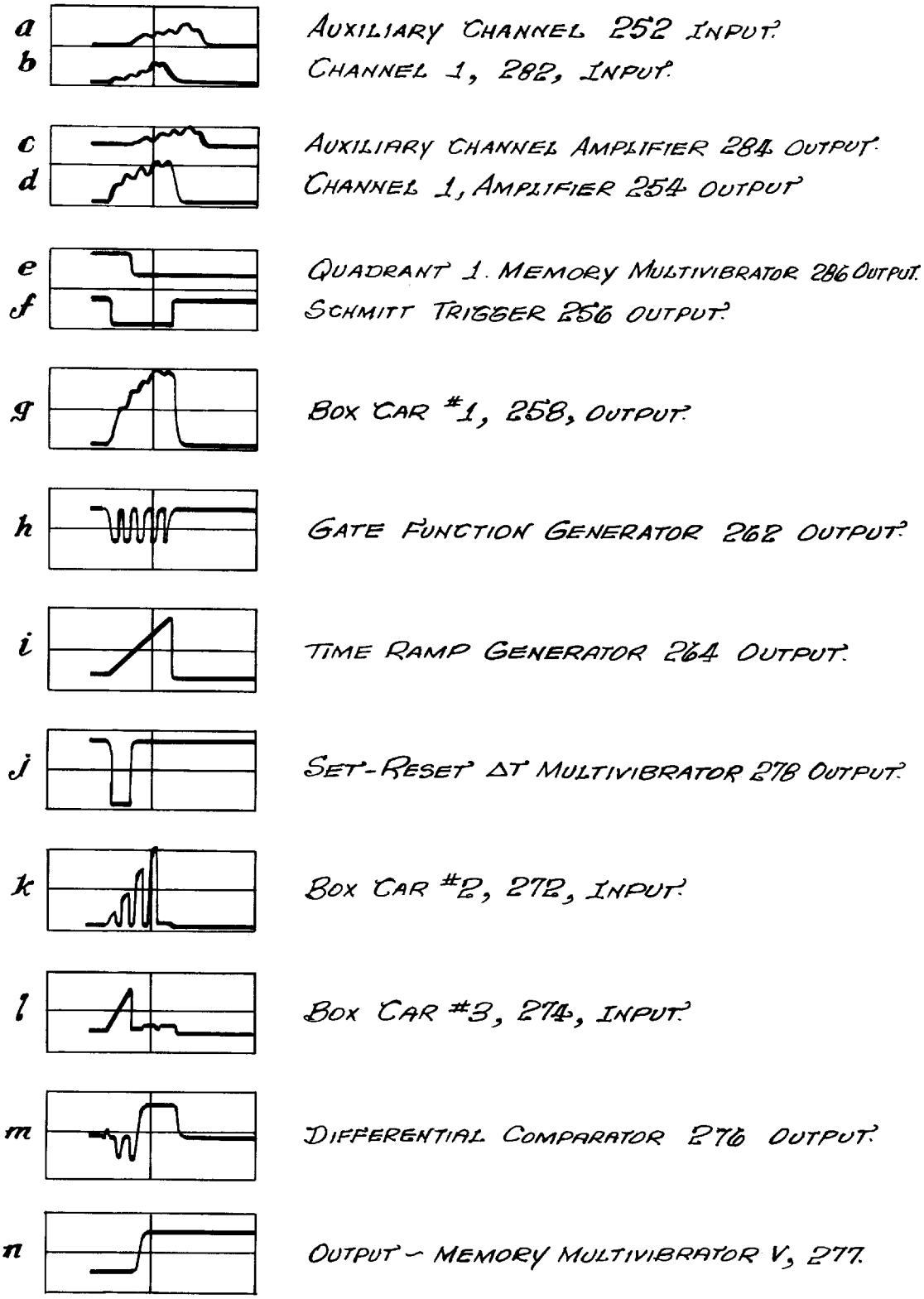
Figure 34:
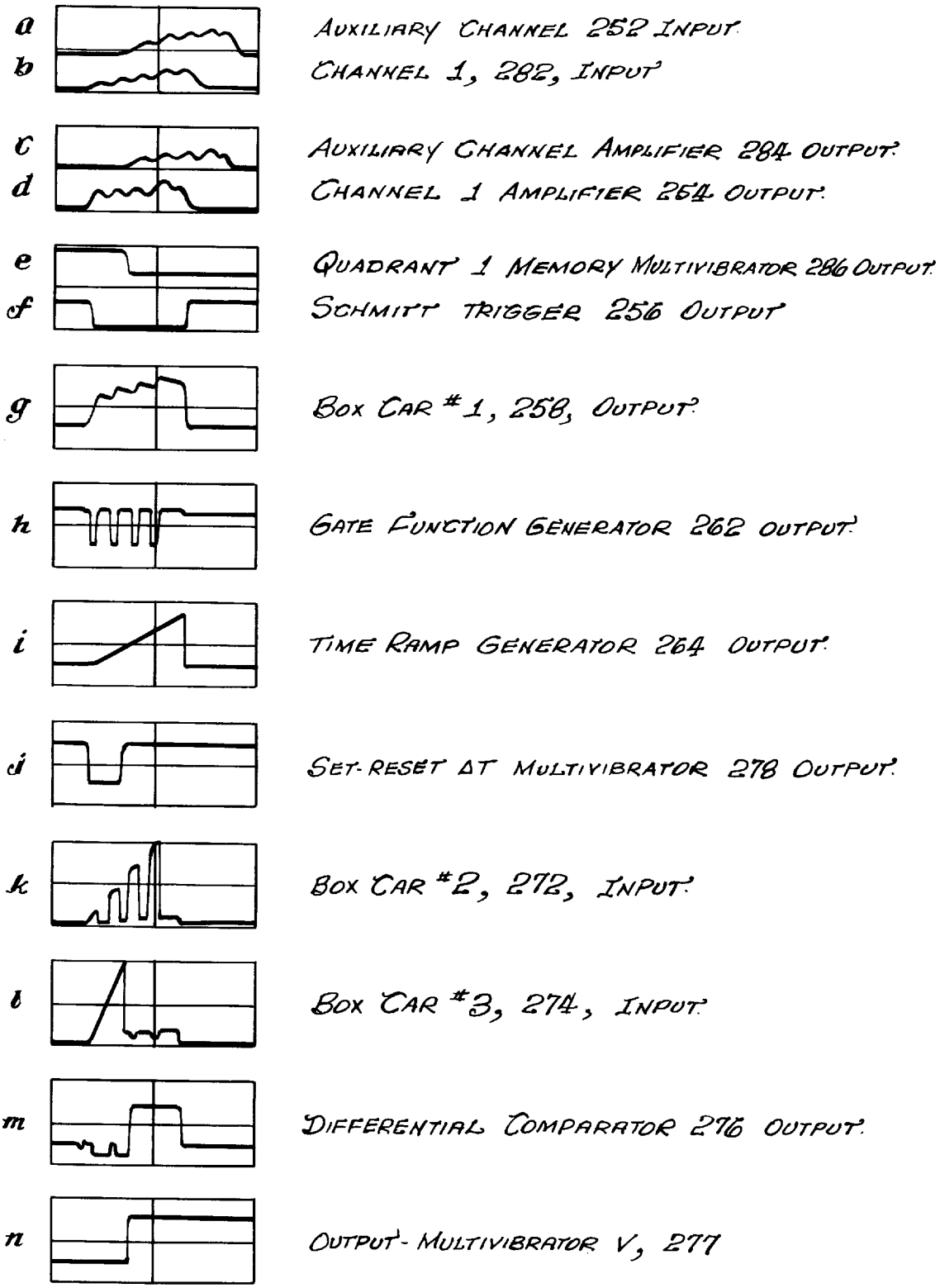
Figure 35:
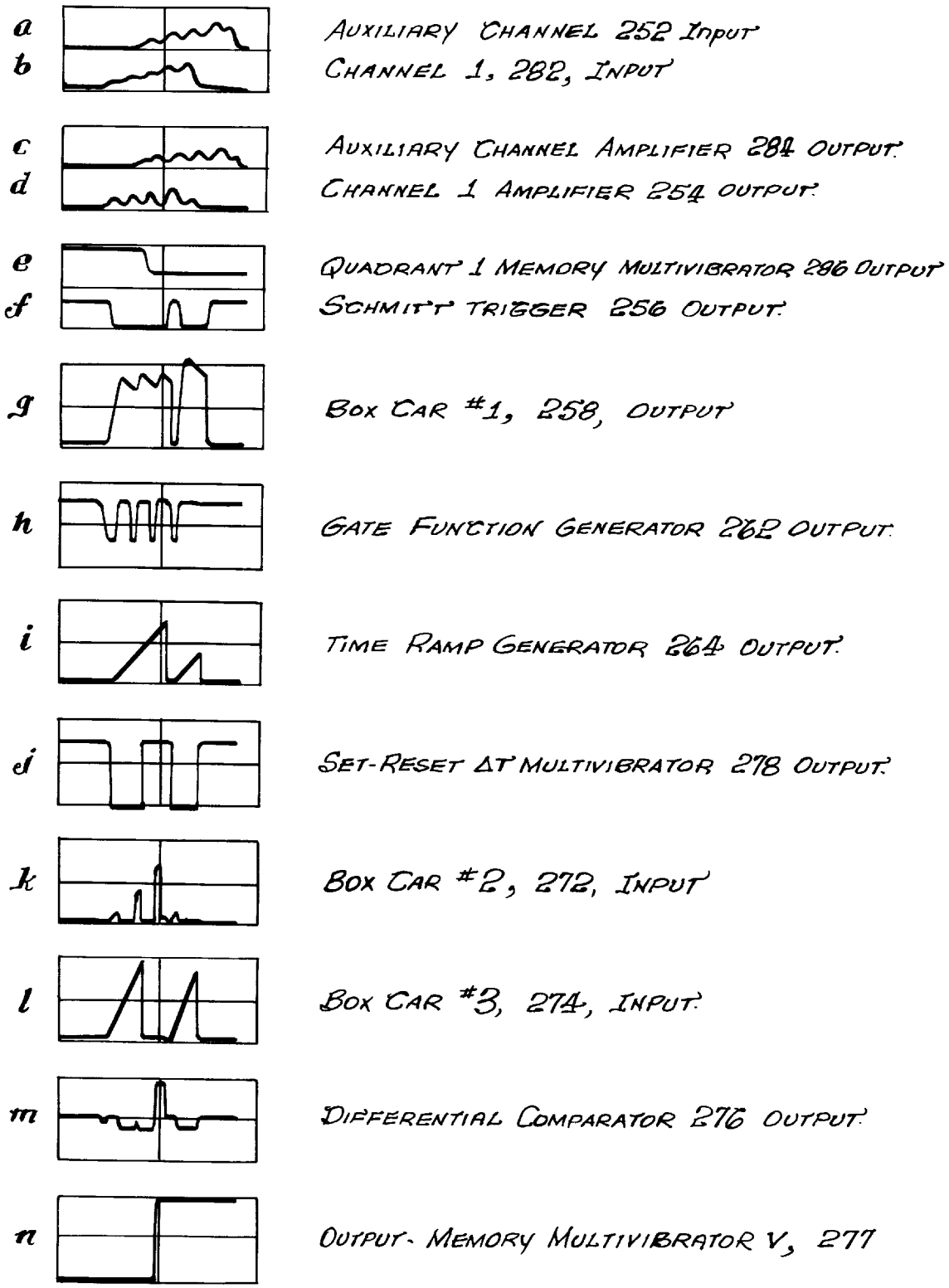
FIG. 35 is a set of signal waveforms developed in TTPOSCCM Ckt. No. 2 with quadrant detection at low velocity intercept.

Oscillograms taken during simulation runs are included in FIGS. 33, 34, and 35 to show the time response capability and resolution of these circuits and also to show the time relationships between the various waveforms. The figures are well labeled but several things may need to be pointed out. The input signals, waveforms (a) and (b) in FIGS. 33, 34, and 35, were chosen to present target signals, with multiple peaks, at three different closing velocities. For a target plume length of twelve feet, FIG. 33 would correspond to a closing velocity of 2,000 ft/sec, FIG. 34 would correspond to a closing velocity of 1,000 ft/sec, and FIG. 35 would correspond to a closing velocity of 500 ft/sec.

It should be noted that waveforms (c) and (d) in FIGS. 33, 34, and 35 which are the amplifier outputs corresponding to the inputs in waveforms (a) and (b), are not linearly amplified versions of the input signals. Differentiation of the signals, particularly for the low closing velocity of FIG. 35, is a consequence of the low frequency background signal rejection filtering designed into the amplifiers. Also the channel 1 amplifier has nonlinear signal compression transfer characteristics designed to improve the overall circuit performance through a very extensive dynamic range of detector voltages. In each of these figures the horizontal time axes are aligned to show timing relationships.

Some important cause-and-effect relationships demonstrated in the waveforms are:

(1) Waveform e—the auxiliary channel signal is threshold detected and quadrant information is stored for a preset fixed time for use by the aimable warhead.

(2) waveform f—the channel 1 signal is threshold detected. This is an important waveform as it controls the dumping or resetting of the boxcar circuits 258, 272 and 274 and the time ramp generator 264 (all in FIG. 31), as illustrated by the temporary dropout of signal in FIG. 35. Additional simple logic could be provided to dump the quadrant memory multivibrators 286, 296, 306 and 316 on loss of channel 1 signal if a firing decision has not been made. Such a feature would be useful when a target followed a decoy through the same quadrant during one memory time interval.

(3) waveform g—the function of boxcar #1, 258, is to detect and hold the successive peaks of the channel 1 signal if the peak is larger than any peak preceding it. A controlled amount of decay is designed into this holding circuit to compensate for the differentiation in the amplifiers.

(4) waveform h—the gate function generator 262 operates on the boxcar #1, 258, output and generates a gating pulse for each successive signal peak which is greater than the preceding peak.

(5) waveform i—this function is turned on and reset by the Schmitt trigger 256, and serves as a time reference.

(6) waveform j—this gating function is turned on (set) by the Schmitt trigger 256, at the beginning of the channel 1 signal, and reset by the quadrant memory multivibrator 286 at the beginning of the auxiliary channel signal.

(7) waveform k—the boxcar #2, 272, input is the time ramp gated by waveform h.

(8) waveform l—the boxcar #3, 274, input is the time ramp gated by waveform j. (The boxcar #2 and #3, 272 and 274 outputs are not measured separately but are immediately differentially combined.)

(9) waveform m—this waveform is obtained by differential amplification of the output voltages of boxcars #2 and #3, 272 and 274, with high gain and limiting. A positive voltage means that the voltage stored in boxcar #2, 272, (which represents the time of channel 1 voltage peak) has exceeded the voltage stored in boxcar #3, 274, which represents the time of the beginning of the auxiliary channel signal. This overlapping of the time-to-peak in channel 1 and the threshold in the auxiliary channel results in a target decision.

(10) waveform n—the target decision is stored for a fixed preset memory time and, if a signal occurs in channel 2 during the memory time interval, the fuze fires the warhead into the quadrant through which the target is passing.

The circuit has been shown to have sufficient time response capability and resolution to perform the desired functions of measuring the angular size and symmetry of sources intercepted by the missile.

The sun signal rejection characteristics of the TTPOSCCM Ckt. No. 2 are a very important feature of the invention. Sun signal rejection is achieved in present IR fuzes by observing the time relationships between signals in two detection beams. The TTPOSCCM rejects sun signals by the same measurements of source size and symmetry that are utilized in flare decoy rejection. The OSCCM is also capable of discriminating against the sun but the optics must have excellent sidelobe suppression. The sun may generate very large signals at the detectors of a fuze. The possibility of generating a target indication in the TTPOSCCM Ckt. No. 2 due to secondary effects of the very large sun signals has been investigated by laboratory and "roof top" experiments. All tests conducted to date have indicated that the circuits do very effectively discriminate against sun signals.

Samples of the results of one "roof top" experiment in sun rejection with the TTPOSCCM circuit are shown in FIG. 36. The presence of high altitude rapidly moving clouds of varying densities allowed viewing the sun under conditions varying from unobstructed sky, sun through partially transmitting thin clouds, and conditions where the direct radiation from the sun was almost totally blocked by clouds. The procedure was to rotate the optical unit containing the beam 1 and auxiliary beam optics about a pitch or yaw axis such that the sun passed through the field of view of the two beams. The resultant detector signals and the output of the circuits were displayed on an oscilloscope and recorded on film. The optical unit was rotated at various angular rates for each of the following situations: Sun passing first through a beam 1 and then through the auxiliary channel, sun passing first through the auxiliary channel and then through channel 1, and "dithering" the sun repetitiously through either or both of the beams. At no times were target indications observed. A target indication in FIG. 36 would be a positive signal in the bottom trace above the initial voltage at the left of the trace.

The ability of the TTPOSCCM circuits to discriminate against the sun using forward beams only may find applications in high angle intercepts where a rear-looking beam is a liability causing poor warhead burst-point timing.

Laboratory simulation results show that a three-beam passive fuze, utilizing the overlapping signal processing scheme or its "time-to-peak" variation, would have a very low susceptibility to pyrotechnic flare decoy countermeasures. For the parameters used in the simulation, a typical flare would have to pass within 4 feet of the fuze in order to be incorrectly identified as a target. The same fuze, without the auxiliary beam and associated logic circuitry, would identify flares as targets anywhere within a radius of 50 feet.

The target detection characteristics of the three-beam fuze are essentially identical to the two-beam type, however, the two forward beams (channel 1 and the auxiliary channel) could be used in a "forward beams only" mode for operations involving high intercept angles, thereby overcoming an inherent disadvantage of the typical two-beam fuze. Sun signal rejection, an important characteristic for "forward beams only" operation, has been shown to be excellent with the TTPOSCCM circuits and an separation of 8° between the two forward beams.

Obviously many modifications and variations of the present invention are possible in the light of the above teachings. It is therefore to be understood that within the scope of the appended claims the invention may be practiced otherwise than as specifically described.

What is claimed is:

1. A passive guided missile fuze, capable of detecting the presence of a target, having an axis which coincides substantially with the direction of forward motion of the missile, the fuze including three detectors for detecting sequentially in time three separate beams of electromagnetic radiation from the target, the beams forming angles with the axis, the two detectors which first detect the presence of a target being the forward detectors, the missile fuze detecting the presence of a target when the two forward detectors simultaneously detect two beams of radiation from the target, the fuze comprising:

circuitry for a first channel, connected to the output of that detector which first detects the presence of the target;

circuitry for an auxiliary channel, connected to the output of that detector which next in time detects the presence of the target;

the two circuitries serving to determine the presence of the target when there is simultaneous detection of the target by both detectors; and circuitry for a second channel, connected to the output of the third detector, for activating the fuze after the detectors of the first two named circuitries have simultaneously detected detected the presence of the target.

2. A missile fuze according to claim 1, wherein the electromagnetic radiation is infrared radiation and the detectors are infrared detectors which transduce an infrared signal into an electrical signal.

3. A missile fuze according to claim 2, wherein the detector associated with the first channel circuitry continuously detects and monitors infrared radiation from the target and records the instant of time at which a maximum amount of infrared radiation is detected; and wherein the presence of a target is determined when this maximum amount of radiation is detected by the first channel detector simultaneously with the detection by the auxiliary channel detector of infrared radiation from the target having a magnitude greater than a predetermined threshold level.

4. A missile fuze according to claim 3, wherein the infrared detector associated with the auxiliary channel comprises four detectors, each monitoring a different quadrant of space arranged about the missile axis, so that the specific quadrant in which the target is located may be determined by detection of the radiation from that quadrant of space; and the circuitry for the auxiliary channel comprises four quadrant circuits, one connected to the output of each quadrant detector.

5. A missile fuze according to claim 2, wherein the first, auxiliary, and second channel circuits each comprise:

a preamplifier connected respectively to the output of the first, auxiliary, and second channel infrared detector, for amplifying the transduced input signal;

a buffer amplifier, whose input is connected to the output of the preamplifier of its respective channel circuit, also serving to increase the input impedance for the preamplifier;

a Schmitt trigger, whose input is connected to the output of the buffer stage of its respective channel circuit, for generating a rectangular pulse having a width which corresponds to the time duration or width of the detected infrared signal; and wherein the first channel circuit further comprises:

a first channel differentiating circuit, or differentiator, whose input is connected to the output of the first channel Schmitt trigger and whose output is a differentiated pulse; a first coincidence circuit, whose inputs are the differentiated pulse from the first channel differentiator and the rectangular pulse from the auxiliary channel Schmitt trigger, the coincidence of the two pulses indicating the presence of a target;

a memory circuit, whose input is connected to the output of the first coincidence circuit, which keeps a time record of the instant at which time coincidence of the two pulses indicating the presence of a target takes place; and wherein the second channel circuit further comprises:

a second channel differentiator, whose input is connected to the output of the second channel Schmitt trigger and whose output is a differentiated pulse which determines the time of triggering the fuze;

a second channel coincidence circuit, whose inputs are the differentiated pulse from the second channel differentiator and the output from the memory circuit, and whose output is a signal which causes triggering of the fuze.

6. A missile fuze according to claim 5, further comprising:

an amplifier stage in the first, auxiliary, and second channel circuits between the buffer stage and the Schmitt trigger.

7. A missile fuze according to claim 3, wherein the circuitry for the first channel comprises:

a first channel detector for detecting infrared radiation from the target,and transducing it into an electrical signal;

a first channel 1 amplifier, whose input is connected to the output of the first channel detector, for amplifying the transduced electrical signal;

a first channel threshold detector and squaring circuit, whose input is connected to the first channel 1 amplifier;

a fixed memory time monostable, whose input is connected to the output of the channel 1 threshold detector and squaring circuit, whose timing is controlled by the leading edges of the output signal of the channel 1 squaring circuit;

a first boxcar circuit, whose inputs are connected to the outputs of the first channel amplifier and the fixed memory time monostable, which serves as a peak-holding circuit whose output always reflects the peak value of its input;

a gate function generator, (whose) input is connected to the output of the first boxcar circuit, which generates a gate voltage only during the positive-going portion of its input, the trailing edges of the gate pulses occurring simultaneously with the peaks of the first channel signal;

a gate and second boxcar circuit, whose inputs are the outputs of the fixed memory time monostable and the gate function generator, and having an output voltage whose amplitude is proportional to $t_{max}$, the time that it takes the first channel detected infrared signal to peak;

a timing ramp generator, which is initiated and reset by the output signal of the fixed memory time monostable, and whose output is a voltage that is linearly proportional to time and feeds into the gate and second boxcar circuit;

a differential comparison circuit, one of whose two inputs is the output of the gate and second boxcar circuit; and wherein the circuitry for the auxiliary channel comprises:

an auxiliary channel detector for detecting infrared radiation from the target, generally after the first channel detector's detection of the radiation, and transducing it into an electrical signal;

a second channel amplifier, whose input is connected to the output of the auxiliary channel detector, for amplifying the transduced electrical signal;

a second channel threshold detector and squaring circuit whose input is connected to the second channel amplifier;

ΔT multivibrator which is set, via the memory time monostable, by the leading edge of the output signal of the first channel squaring circuit and reset by the leading edge of the output signal of the auxiliary channel squaring circuit, the output of the ΔT multivibrator being a measure of the interval of time between signal thresholds in the first and auxiliary channels;

a gate and third boxcar circuit (whose) inputs are output signals from the fixed memory time monostable, the timing ramp generator and the ΔT multivibrator, the output voltage being proportional to $t_1$, the time at which the auxiliary channel first begins to detect infrared radiation;

a differential comparison circuit, (whose) inputs are the output voltages of the second and third boxcar circuits, which are proportional to the times $t_{max}$ and $t_1$, respectively;

the comparison circuit having the function of checking the condition of $t_{max}-t_1 \geqq 0$:

(1) if the output voltage of the second boxcar circuit at time $t_{max}$ is equal to or less than the output voltage of the third boxcar circuit at time $t_1$, there is no output signal from the comparison circuit, indicating the detection of a real target;

(2) if the output voltage of the third boxcar circuit at time $t_1$ is greater than that of the second boxcar circuit at time $t_{max}$, there is an output signal from the comparison circuit, indicating the detection of a decoy target.

8. A missile fuze according to claim 7 further comprising:

a second channel 1 amplifier, whose input is the output of the first channel 1 amplifier and whose output is the input to the first boxcar circuit, for further amplifying the transduced electrical signal; and a third channel 1 amplifier, whose input is also connected to the output of the first channel 1 amplifier, and whose output is the input to the first channel threshold detector and squaring circuit, for further amplifying its input signal.

9. A missile fuze according to claim 6, wherein each of the four quadrant circuits comprises:

a detector and bias network, for detecting infrared radiation from a quadrant of space and transducing it into an electrical signal;

a linear quadrant amplifier, whose input is connected to the output of the bias network, for amplifying the transduced quadrant signal; and a memory multivibrator, whose input is connected to the output of the linear quadrant amplifier, which stores information regarding target detection by the detector of its respective quadrant circuit simultaneously with the detection of a target by the first channel detector; and further comprising:

an OR circuit, whose inputs are the four outputs from the four memory multivibrators, which has an output signal when the first channel detector and any of the four quadrant detectors have simultaneously detected a target; and a selective firing circuit for an aimable warhead connected to the outputs of the quadrant multivibrators, which determine into which quadrant the missile will be fired, and also connected to the second channel circuitry for determination of the time of firing.

* * * * *